US012269700B2

(12) United States Patent
Taira et al.

(10) Patent No.: US 12,269,700 B2
(45) Date of Patent: Apr. 8, 2025

(54) SHEET CONVEYOR AND IMAGE FORMING APPARATUS

(71) Applicant: BROTHER KOGYO KABUSHIKI KAISHA, Nagoya (JP)

(72) Inventors: Kazuya Taira, Nagoya (JP); Mariko Uchida, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 197 days.

(21) Appl. No.: 18/065,132

(22) Filed: Dec. 13, 2022

(65) Prior Publication Data

US 2023/0183028 A1 Jun. 15, 2023

(30) Foreign Application Priority Data

Dec. 14, 2021 (JP) ..... 2021-202767
Mar. 4, 2022 (JP) ..... 2022-033609

(51) Int. Cl.
*B65H 3/06* (2006.01)

(52) U.S. Cl.
CPC ..... *B65H 3/06* (2013.01); *B65H 2403/724* (2013.01); *B65H 2403/73* (2013.01); *B65H 2404/16* (2013.01); *B65H 2801/03* (2013.01)

(58) Field of Classification Search
CPC ..... B65H 3/06; B65H 3/0638; B65H 3/0669; B65H 3/0684; B65H 2404/16; B65H 2403/72; B65H 2403/724; B65H 2403/73; B65H 2601/324; B65H 5/062; B65H 2801/03; B65H 2801/06; G03G 21/186; G03G 21/1857; F16D 3/202; F16D 3/18; F16D 3/185
USPC ..... 271/10.09, 18, 18.1
See application file for complete search history.

(56) References Cited

U.S. PATENT DOCUMENTS 7,971,872 B2 * 7/2011 Omura ..... F16D 11/04 464/160
8,270,876 B2 * 9/2012 Morioka ..... G03G 21/1853 399/167
9,851,691 B2 * 12/2017 Zeng ..... F16D 3/04
11,579,560 B2 * 2/2023 Okamoto ..... G03G 21/186
2008/0304865 A1 12/2008 Omura et al.
2013/0051871 A1 2/2013 Yagata et al.

FOREIGN PATENT DOCUMENTS

JP 2008-304776 A 12/2008
JP 2013-45033 A 3/2013

* cited by examiner

*Primary Examiner* — Leslie A Nicholson, III
(74) *Attorney, Agent, or Firm* — Merchant & Gould P.C.

(57) ABSTRACT

A groove has a first side surface and a second side surface. The second side surface faces the first side surface and is located downstream of the first side surface in a first direction. The first side surface has a first contact surface configured to contact one side surface of a protrusion. The second side surface having a second contact surface and a guide surface. The second contact surface is smaller than the first contact surface. The second contact surface is configured to contact an other side surface of the protrusion. The guide surface is inclined away from the first contact surface in a direction from a tip-side end of the second contact surface toward a tip end of a drive shaft. The tip-side end is an end facing toward the tip end of the drive shaft. The guide surface is configured to guide the protrusion to the groove.

22 Claims, 18 Drawing Sheets

SHEET CONVEYOR AND IMAGE FORMING APPARATUS

REFERENCE TO RELATED APPLICATIONS

This application claims priority from Japanese Patent Application Nos. 2021-202767 filed on Dec. 14, 2021 and 2022-033609 filed on Mar. 4, 2022. The entire content of each of the priority applications is incorporated herein by reference.

BACKGROUND ART

In an image forming apparatus such as a laser printer, a joint mechanism for connecting a drive shaft of an apparatus main body and a driven shaft of a feeder and so on is provided.

DESCRIPTION

In a joint mechanism of an image forming apparatus, a drive shaft of an apparatus main body and a driven shaft of a feeder and so on are connected coaxially in order to transmit a driving force from the apparatus main body to the feeder and so on.

For example, in a configuration in which a coupling provided on a drive shaft of an apparatus main body engages an engagement pin provided on a driven shaft of a feeder, the coupling is provided with a pin guide having a plurality of pairs of inclined portions along the circumferential direction. In this configuration, by guiding the engagement pin along the inclined portion, it becomes easier to assemble the engagement pin to the coupling.

In recent years, reduction of the size of each component is required in order to make an apparatus more compact. However, according to the above configuration, the contact area between the coupling and the engagement pin is reduced due to the inclined portion of the coupling. In this case, the pressure applied per unit area (hereinafter referred to as surface pressure) increases, and the strength required to transmit the driving force cannot be ensured. Thus, in order to ensure the necessary strength, it is necessary to increase the contact area between the coupling and the engagement pin, which causes the problem of increasing the size of the joint mechanism.

In view of the foregoing, an example of an object of this disclosure is to provide a sheet conveyor and an image forming apparatus including a joint mechanism that achieves ease of assembly, strength necessary for transmitting driving force, and reduction of the size.

According to one aspect, this specification discloses a sheet conveyor. The sheet conveyor includes a sheet tray, a motor, a drive shaft, a roller, and a hollow portion. The sheet tray is configured to support a sheet. The drive shaft extends in an axial direction. The drive shaft has a tip end in the axial direction. The drive shaft having an end portion including the tip end. The drive shaft is rotatable in a first direction by receiving driving force of a forward rotation of the motor. The roller is rotatable to feed the sheet supported by the sheet tray. The hollow portion is provided at the roller coaxially with the roller. The end portion of the drive shaft is inserted in the hollow portion. The hollow portion has an inner surface and a protrusion. The protrusion protrudes radially inward from the inner surface and extends in the axial direction. The end portion of the drive shaft has a groove configured to fit to the protrusion. The groove has a first side surface and a second side surface. The second side surface faces the first side surface and is located downstream of the first side surface in the first direction. The first side surface has a first contact surface configured to contact one side surface of the protrusion. The second side surface having a second contact surface and a guide surface. The second contact surface is smaller than the first contact surface. The second contact surface is configured to contact an other side surface of the protrusion. The guide surface is inclined away from the first contact surface in a direction from a tip-side end of the second contact surface toward the tip end of the drive shaft. The tip-side end of the second contact surface is an end facing toward the tip end of the drive shaft. The guide surface is configured to guide the protrusion to the groove. According to another aspect, this specification also discloses an image forming apparatus. The image forming apparatus includes a sheet conveyor and a print engine configured to form an image on a sheet fed from the sheet conveyor. According to still another aspect, this specification also discloses a sheet conveyor. The sheet conveyor includes a motor, a roller, and a drive shaft. The roller is rotatable to convey a sheet. The drive shaft extends in an axial direction. The drive shaft has a tip end in the axial direction. The drive shaft has an end portion including the tip end. The drive shaft is rotatable in a first direction by receiving driving force of a forward rotation of the motor. The drive shaft is configured to transmit the driving force to the roller. The end portion of the drive shaft has a groove. The groove has a first side surface and a second side surface. The second side surface faces the first side surface and is located downstream of the first side surface in the first direction. The first side surface has a first contact surface. The second side surface has a second contact surface and a guide surface. The second contact surface is smaller than the first contact surface. The guide surface is inclined away from the first contact surface in a direction from a tip-side end of the second contact surface toward the tip end of the drive shaft. The tip-side end of the second contact surface is an end facing toward the tip end of the drive shaft.

According to the above configuration, since the guide surface is provided, ease of assembly between the drive shaft and the hollow portion is ensured. Since the first contact surface to which surface pressure is applied when transmitting the driving force is larger than the second contact surface to which the surface pressure is not applied when transmitting the driving force, the strength necessary for transmitting the driving force is ensured. By making the second contact surface smaller and providing the guide surface, the size of the hollow portion is reduced.

The sheet conveyor and the image forming apparatus according to this disclosure include a joint mechanism that achieves ease of assembly, strength necessary for transmitting driving force, and reduction of the size.

IMAGE FORMING APPARATUS

Figure 1:
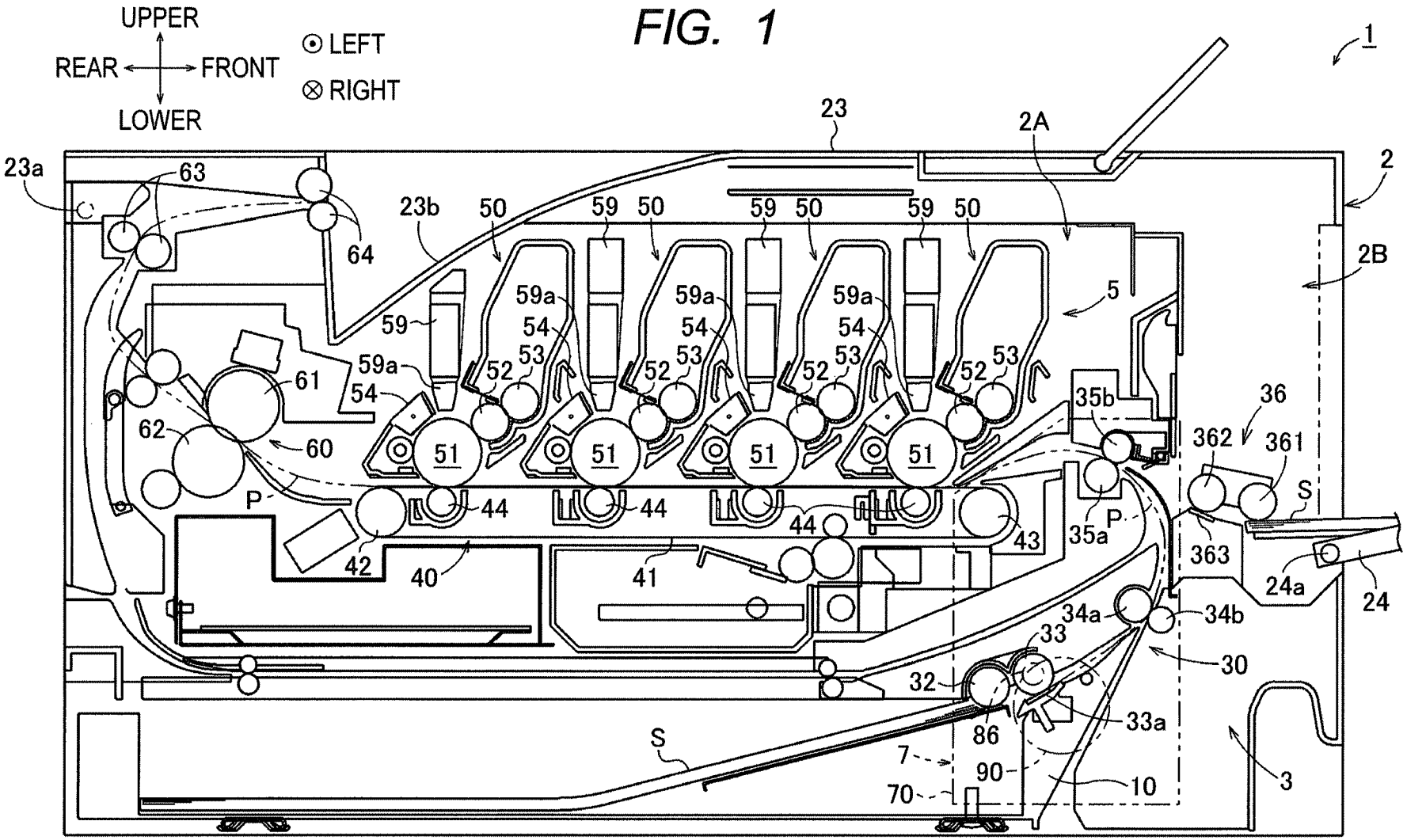
FIG. 1 is a central cross-sectional view of an image forming apparatus.

FIG. 1 shows an image forming apparatus according to an embodiment of the present disclosure. For example, the image forming apparatus 1 is a color laser printer that forms images of multiple colors on a sheet S by an electrophotographic method.

In the following description, the right side and the left side in FIG. 1 are defined as the front side and the rear side of the image forming apparatus 1, respectively. The near side and the far side in a direction perpendicular to the drawing sheet of FIG. 1 are defined as the left side and the right side of the image forming apparatus 1, respectively. Further, the upper side and the lower side in FIG. 1 are defined as the upper side and the lower side of the image forming apparatus 1, respectively.

The image forming apparatus 1 includes an apparatus main body 2, a supply section 3, and a print engine (image forming section) 5. The supply section 3 includes a supply tray 10 as an example of a sheet tray for supporting the sheet S and a sheet conveyor 30 for conveying the sheet S. The print engine 5 forms an image on the sheet S supplied from the supply section 3.

The apparatus main body 2 is formed in a substantially rectangular parallelepiped shape and accommodates the supply section 3 and the print engine 5. An upper opening 2A is opened in the upper surface of the apparatus main body 2, and the apparatus main body 2 has a top cover 23 configured to open and close the upper opening 2A. A front opening 2B is opened in the front surface of the apparatus main body 2, and the apparatus main body 2 has an MP (multi-purpose) tray 24 configured to open and close the front opening 2B.

The top cover 23 is rotatable about a rotation shaft 23*a* at the rear end, and rotates about the rotation shaft 23*a* to be movable between a closed position at which the upper opening 2A is closed (the position shown in FIG. 1) and an open position at which the upper opening 2A is opened. A discharge tray 23*b* that slopes downward from the front side toward the rear side is formed at the top cover 23 of the apparatus main body 2.

The MP tray 24 is movable between a closed position (the position indicated by the double-dot chain line in FIG. 1) at which the front opening 2B is closed and an open position (a position indicated by a solid line in FIG. 1) at which the front opening 2B is opened, by rotating about a rotation shaft 24*a*. The MP tray 24 is configured to support a plurality of stacked sheets S when the MP tray 24 is in the open position.

The supply section 3 is arranged at the lower part of the apparatus main body 2, and conveys the sheet S supported by the supply tray 10 to the print engine 5 by the sheet conveyor 30. The supply tray 10 is slidable in the front-rear direction, and is movable between an accommodation position at which the supply tray 10 is accommodated in the apparatus main body 2 and a separation position at which the supply tray 10 is pulled forward from the accommodation position.

The sheet conveyor 30 includes a supply roller 32, a separation roller 33 which is an example of a roller, a separation pad 33*a*, a conveyance roller 34*a*, and a registration roller 35*a*. The separation roller 33 is an example of a roller that feeds the sheet S supported by the supply tray 10. In the apparatus main body 2, a conveyance path P for the sheet S is formed from the supply tray 10 to the discharge tray 23*b* via the print engine 5.

The sheets S supported by the supply tray 10 are separated one sheet at a time by the supply roller 32, the separation roller 33 and the separation pad 33*a*, and fed to the conveyance path P. The supply roller 32 is a roller that supplies the sheet S supported by the supply tray 10 toward the print engine 5. The separation roller 33 is a roller that separates and feeds the sheets S supplied from the supply roller 32 one sheet at a time. The separation roller 33 and the separation pad 33*a* constitute separation means for separating the sheets S one sheet at a time.

The sheet S fed to the conveyance path P is conveyed toward the print engine 5 by the conveyance roller 34*a*, a roller 34*b* arranged to face the conveyance roller 34*a*, the registration roller 35*a*, and a registration roller 35*b* arranged to face the registration roller 35*a*. The registration roller 35*a* regulates the movement of the leading edge of the conveyed sheet S to temporarily stop the same, and then conveys the sheet S toward the print engine 5 at a particular timing.

The image forming apparatus 1 includes a supply mechanism 36 that conveys the sheet S supported by the MP tray 24 to the print engine 5. The supply mechanism 36 includes a supply roller 361, a separation roller 362 and a separation pad 363. The sheets S supported by the MP tray 24 are separated one sheet at a time by the supply roller 361, the separation roller 362 and the separation pad 363, and fed to the conveyance path P. The sheet S fed to the conveyance path P is conveyed toward the print engine 5 by the registration roller 35*a*.

The print engine 5 is arranged above the supply section 3, and includes four process cartridges 50 arranged side by side in the front-rear direction. Each process cartridge 50 is provided for each color of black, yellow, magenta, and cyan. The process cartridges 50 are detachably attached to the apparatus main body 2. The process cartridge 50 includes a photosensitive drum 51, a development roller 52, a supply roller 53 and a charger 54.

The process cartridge 50 is mounted in the apparatus main body 2 in a state where the drum axis of the photosensitive drum 51 extends in the left-right direction. The development roller 52 is movable between a contact position where the development roller 52 contacts the photosensitive drum 51 and a separation position where the development roller 52 separates from the photosensitive drum 51. The supply roller 53 supplies toner contained in the process cartridge 50 to the development roller 52.

The apparatus main body 2 includes exposure heads 59 that expose the surfaces of the photosensitive drums 51. The exposure heads 59 are supported by the top cover 23. Four exposure heads 59 are provided for respective ones of the photosensitive drums 51, and are arranged side by side in the front-rear direction. The exposure head 59 extends downward from the top cover 23 and has an exposure portion 59*a* at its lower end. The exposure portion 59*a* is arranged above and close to the photosensitive drum 51 in a state where the top cover 23 is closed. The exposure portion 59*a* is configured by an LED array having a plurality of LED elements arrayed in the left-right direction.

A transfer belt 41 is arranged below the photosensitive drum 51 with the conveyance path P interposed therebetween. The transfer belt 41 is stretched between a drive roller 42 and a follow roller 43 arranged in front of the drive roller 42. The transfer belt 41, the drive roller 42, and the follow roller 43 constitute a belt device 40. Transfer rollers 44 are arranged at positions facing the respective photosensitive drums 51 with the transfer belt 41 interposed therebetween.

In the print engine 5, the photosensitive drum 51 uniformly charged by the charger 54 is selectively exposed by the exposure head 59. This exposure selectively removes charges from the surface of the photosensitive drum 51, and an electrostatic latent image is formed on the surface of the photosensitive drum 51.

The toner contained in the process cartridge 50 is positively charged between the supply roller 53 and the development roller 52, and is borne on the surface of the development roller 52. A developing bias is applied to the development roller 52. When the electrostatic latent image formed on the photosensitive drum 51 faces the development roller 52, toner is supplied from the development roller 52 to the electrostatic latent image due to the potential difference between the electrostatic latent image and the development roller 52. In this way, a toner image is formed on the surface of the photosensitive drum 51.

When the sheet S conveyed toward the print engine 5 reaches the transfer belt 41, the sheet S is conveyed by the transfer belt 41 and sequentially passes between the transfer belt 41 and each photosensitive drum 51. Then, the toner image on the surface of the photosensitive drum 51 is transferred onto the sheet S by a transfer bias applied to the transfer roller 44 when the toner image faces the sheet S.

The transfer belt 41 in this embodiment is configured as a conveyance belt that conveys the sheet S on which a toner image is transferred. Alternatively, a toner image may be transferred onto an intermediate transfer belt, and the toner image transferred on the intermediate transfer belt may be further transferred onto the sheet S.

The sheet S on which the toner image has been transferred is conveyed to a fixing device 60. The fixing device 60 includes a heating roller 61 and a pressure roller 62 in pressure contact with the heating roller 61. When the sheet S passes between the heating roller 61 and the pressure roller 62 of the fixing device 60, the toner image is thermally fixed on the sheet S.

The sheet S on which the toner image is thermally fixed is conveyed from the fixing device 60 to the downstream side in the conveyance direction, and is further conveyed by an intermediate discharge roller pair 63 and a discharge roller pair 64 disposed downstream of the intermediate discharge roller pair 63 in the conveyance direction, and is discharged to discharge tray 23*b*.

Drive Section

The image forming apparatus 1 includes a drive section 7 for driving the separation roller 33, the supply roller 32, the conveyance roller 34*a*, the registration roller 35*a*, the supply mechanism 36, and so on. The drive section 7 includes a motor 90 as a driving source, and a driving force transmission train 70 that transmits the driving force from the motor 90 to the separation roller 33, the supply roller 32, the conveyance roller 34*a*, the registration roller 35*a*, the supply mechanism 36, and so on.

Driving Force Transmission Train

Figure 2:
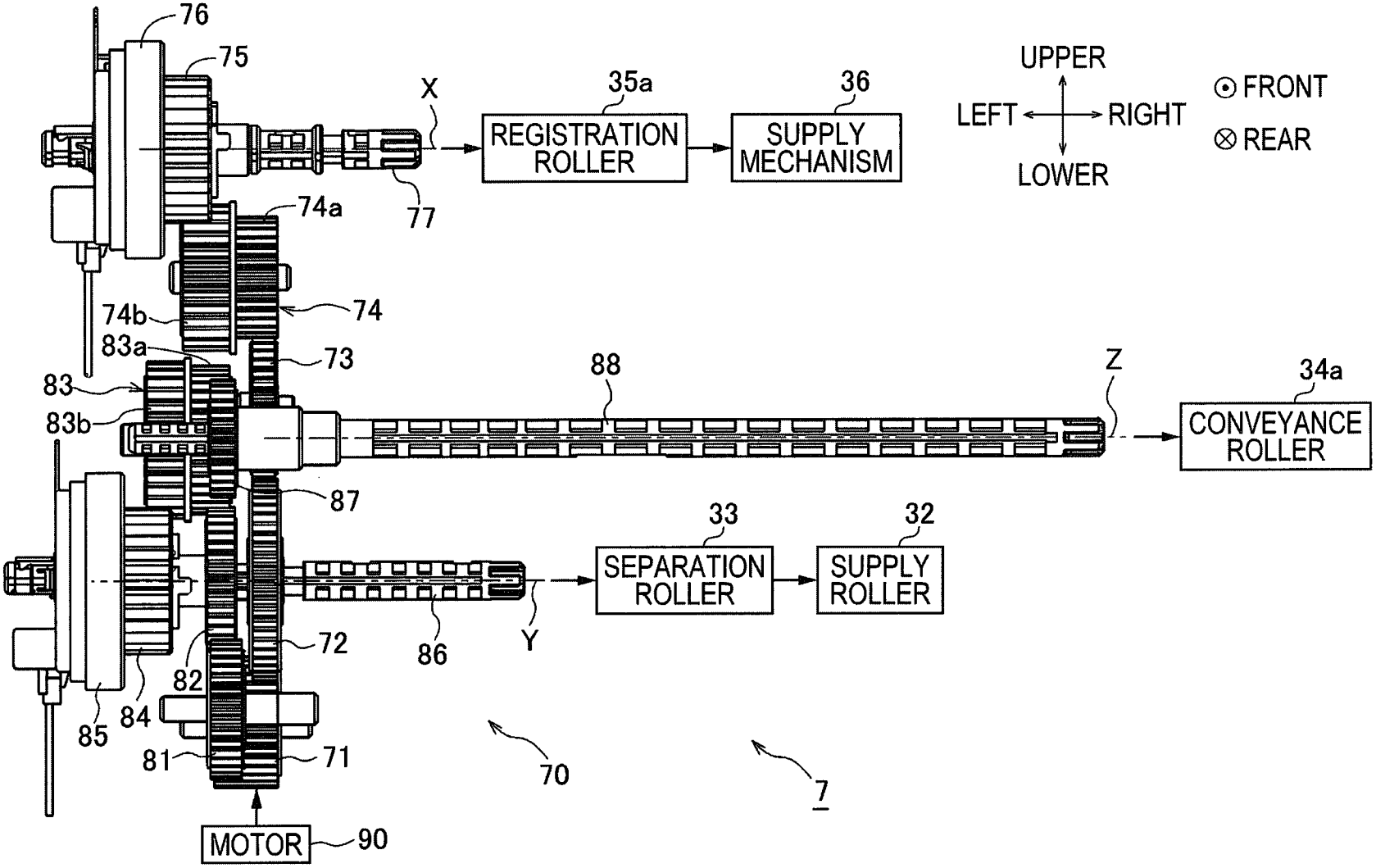
FIG. 2 is a front view of a driving force transmission train.

As shown in FIG. 2, the driving force transmission train 70 includes, as a driving force transmission train for transmitting driving force to the registration roller 35*a* and the supply mechanism 36, includes a branch gear 71, a first idle gear 72, an intermediate gear 73, a fourth idle gear 74, a second output gear 75, a second electromagnetic clutch 76, and a registration roller shaft 77.

The branch gear 71 is connected to the motor 90 via a gear train, and is a gear to which driving force is transmitted from the motor 90. The first idle gear 72 engages with the branch gear 71, and is a gear to which driving force is transmitted from the branch gear 71. The intermediate gear 73 engages with the first idle gear 72. The fourth idle gear 74 is a two-stage gear having a third gear 74*a* and a fourth gear 74*b* integrally arranged adjacent to each other in the left-right direction, and the intermediate gear 73 and the third gear 74*a* engage with each other. The fourth idle gear 74 is a gear to which driving force is transmitted from the first idle gear 72.

The second output gear 75 engages with the fourth gear 74*b* of the fourth idle gear 74. The second electromagnetic clutch 76 is a clutch configured to transmit and cut off the driving force inputted from the second output gear 75 to the registration roller shaft 77. The registration roller shaft 77 rotates about a rotation axis X while the second electromagnetic clutch 76 is transmitting the driving force inputted from the second output gear 75 to the registration roller shaft 77. The registration roller shaft 77 does not rotate when the second electromagnetic clutch 76 cuts off the driving force inputted from the second output gear 75. The rotation axis X of the registration roller shaft 77 extends in the left-right direction.

The registration roller shaft 77 is a rotation shaft of the registration roller 35*a*. The driving force from the motor 90 rotates the registration roller shaft 77, thereby rotating the registration roller 35*a*. The registration roller shaft 77 is connected to the supply mechanism 36, and is configured such that the driving force is transmitted from the registration roller shaft 77 to the supply mechanism 36.

The driving force transmission train 70 includes an intermediate gear 81, a second idle gear 82, a third idle gear 83, a first output gear 84, a first electromagnetic clutch 85, a separation roller shaft 86 as an example of a drive shaft, a conveyance roller output gear 87, and a conveyance roller shaft 88, as a driving force transmission train for transmitting the driving force to the separation roller 33, the supply roller 32, and the conveyance roller 34*a*.

The intermediate gear 81 engages with the branch gear 71. The second idle gear 82 is a gear that engages with the intermediate gear 81. The second idle gear 82 is a gear to which driving force is transmitted from the branch gear 71. The third idle gear 83 is a two-stage gear having a first gear 83*a* and a second gear 83*b* integrally arranged adjacent to each other in the left-right direction. The third idle gear 83 engages with the second idle gear 82. Specifically, the first gear 83*a* of the third idle gear 83 and the second idle gear 82 engage with each other.

The first output gear 84 engages with the third idle gear 83. Specifically, the first output gear 84 engages with the second gear 83*b* of the third idle gear 83. The first electromagnetic clutch 85 is a clutch configured to transmit and cut off the driving force inputted from the first output gear 84 to the separation roller shaft 86. That is, the first electromagnetic clutch 85 is an electromagnetic clutch arranged between the motor 90 and the separation roller shaft 86, and configured to switch between a connection state of transmitting the driving force from the motor 90 to the separation roller shaft 86 and a cut-off state of not transmitting the driving force from the motor 90 to the separation roller shaft 86.

The separation roller shaft 86 rotates about a rotation axis Y when the first electromagnetic clutch 85 is in the connection state and the driving force inputted from the first output gear 84 is transmitted to the separation roller shaft 86. The separation roller shaft 86 rotates in a first direction (a direction in which the sheet S is fed) by the driving force of the forward rotation of the motor 90. The separation roller shaft 86 does not rotate when the first electromagnetic clutch 85 is in the cut-off state and the driving force inputted from the first output gear 84 is not transmitted to the separation roller shaft 86.

The rotation axis Y of the separation roller shaft 86 extends in the left-right direction. The separation roller shaft 86 is a rotation shaft of the separation roller 33. The driving force from the motor 90 rotates the separation roller shaft 86, which rotates the separation roller 33. The separation roller 33 and the supply roller 32 are connected via an idle gear, and the rotation of the separation roller 33 causes the supply roller 32 to rotate.

Thus, by controlling the first electromagnetic clutch 85, the drive to the separation roller shaft 86 is cut off at a constant timing regardless of the length of the sheet S. This prevents feeding of multiple sheets by the separation roller 33 even if the sheet S is short.

The conveyance roller output gear 87 engages with the first gear 83*a* of the third idle gear 83. The conveyance roller shaft 88 is fixed to the conveyance roller output gear 87 so as to be integrally rotatable. When the conveyance roller output gear 87 is rotated by the driving force from the motor 90, the conveyance roller shaft 88 rotates about a rotation axis Z. The rotation axis Z of the conveyance roller shaft 88 extends in the left-right direction. The conveyance roller shaft 88 is a rotation shaft of the conveyance roller 34*a*. The driving force from the motor 90 rotates the conveyance roller shaft 88, which causes the conveyance roller 34*a to rotate.*

Joint Mechanism

A joint mechanism will be described with reference to FIGS. 3 and 4. A separation roller gear 37 is provided at the left end of the separation roller 33. The separation roller gear 37 is an example of a roller gear rotatable about the rotation axis Y. The separation roller gear 37 has a hollow portion 38 into which the right end portion of the separation roller shaft 86 is fitted. The hollow portion 38 has a space (hole) into which the right end portion of the separation roller shaft 86 is fitted. The right end portion of the separation roller shaft 86 and the hollow portion 38 are connected to form a joint mechanism. With this configuration, the separation roller shaft 86 rotates in the first direction (the direction in which the sheet S is fed) by the driving force of the forward rotation of the motor 90, thereby rotating the separation roller gear 37 and the separation roller 33 in the first direction.

Figure 3:
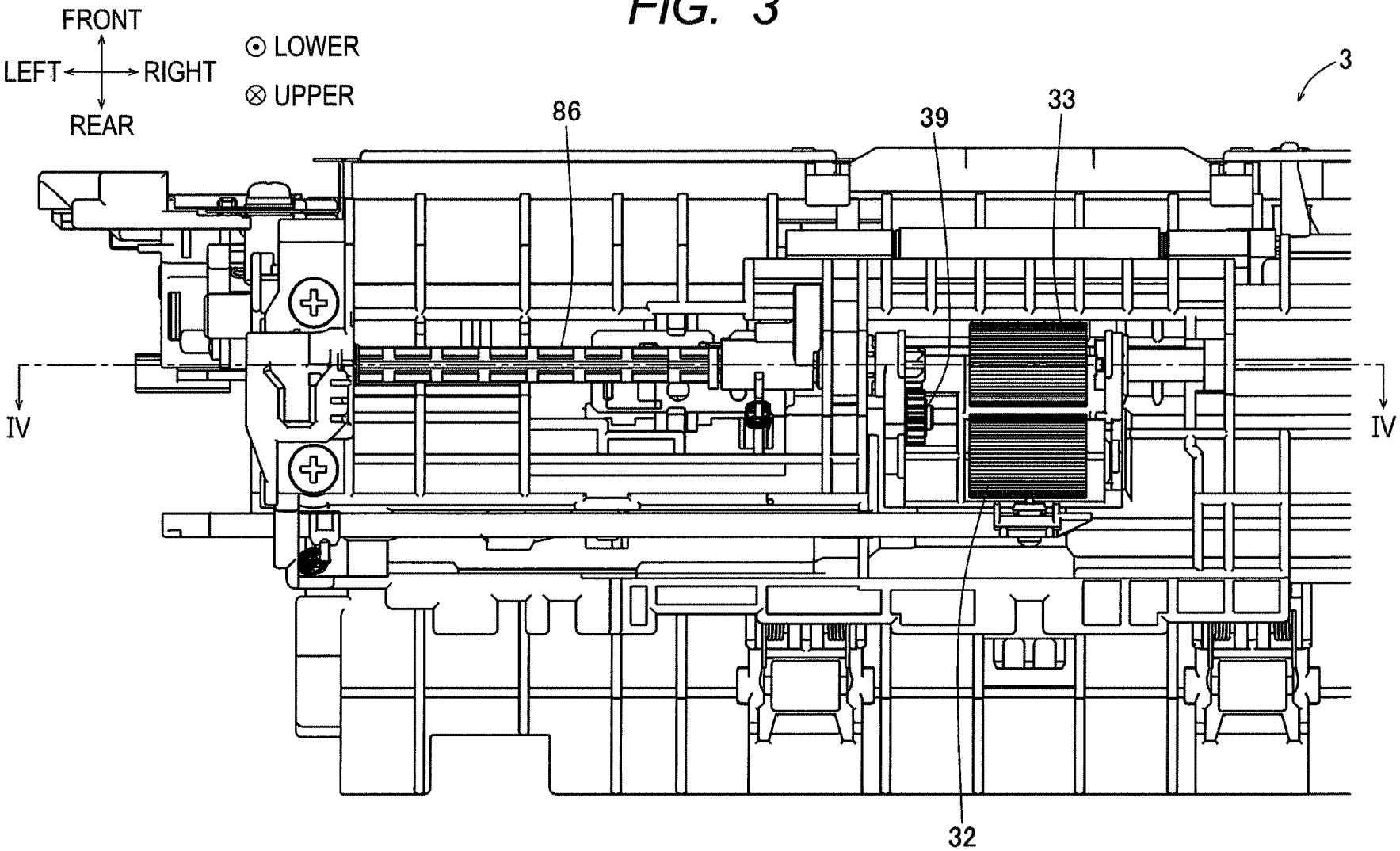
FIG. 3 is a bottom view showing part of a supply section.

The separation roller gear 37 engages with an idle gear 39 (see FIG. 3). The idle gear 39 engages with a supply roller gear 31 (see FIG. 4) provided at the left end of the supply roller 32. Thus, when the separation roller gear 37 rotates, the idle gear 39, the supply roller gear 31, and the supply roller 32 rotate.

Figure 4:
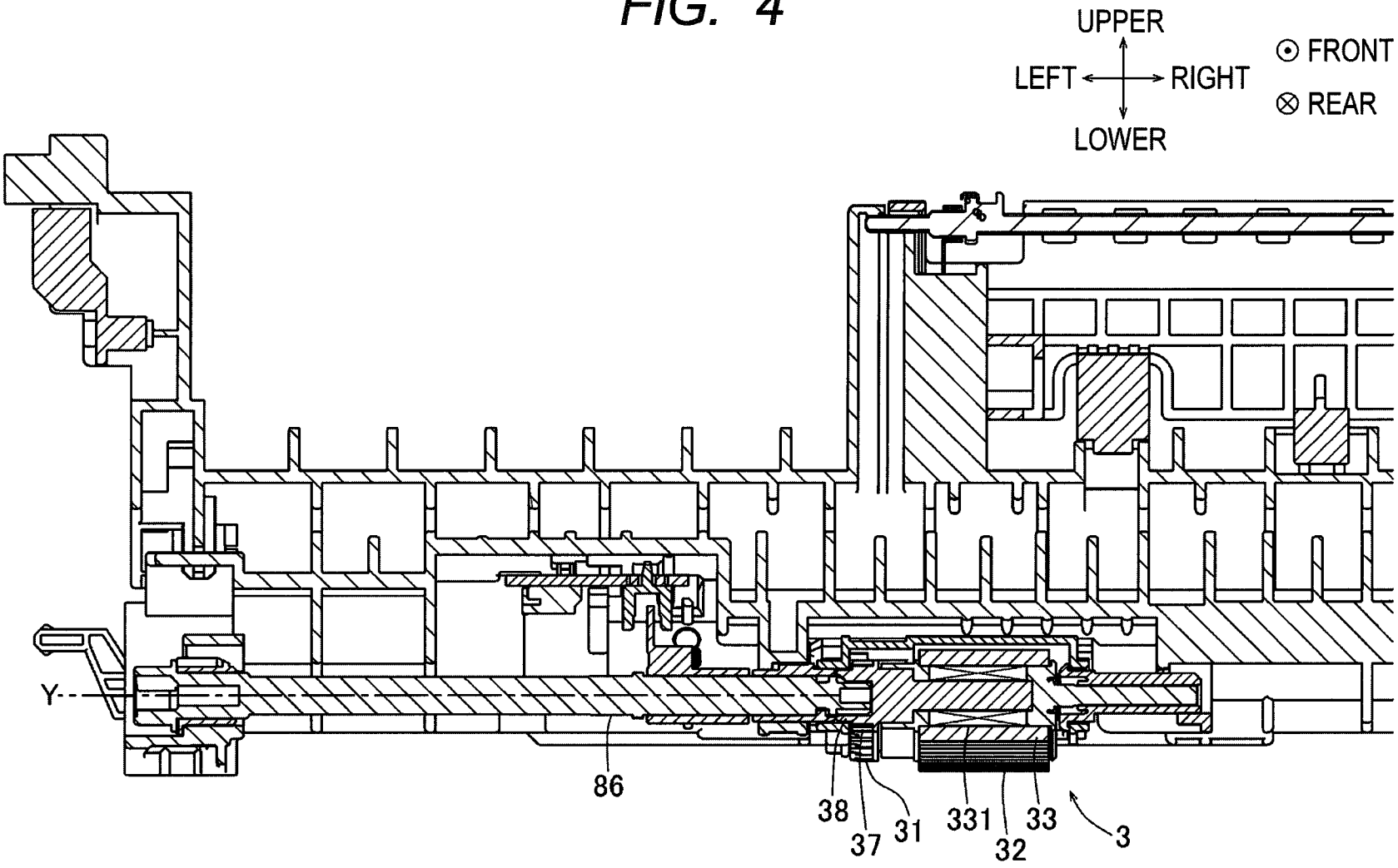
FIG. 4 is a cross-sectional view taken along a line IV-IV of FIG. 3.

As shown in FIG. 4, the separation roller 33 has a one-way clutch 331. The one-way clutch 331 is composed of a plurality of gears arranged inside the separation roller 33. The one-way clutch 331 is configured to connect to the separation roller shaft 86 to transmit the driving force to the separation roller 33 when the separation roller shaft 86 rotates in the first direction, and to allow the separation roller 33 to rotate in the first direction when the separation roller shaft 86 is stopped.

With this configuration, even if the separation roller 33 rotates in the first direction by following the sheet S in a state where the separation roller shaft 86 is stopped and the separation roller 33 is not driven, the separation roller 33 idly rotates relative to the separation roller shaft 86. Thus, excessive surface pressure is not applied to the fitting part between the right end portion of the separation roller shaft 86 and the hollow portion 38.

Hollow Portion

Figure 5:
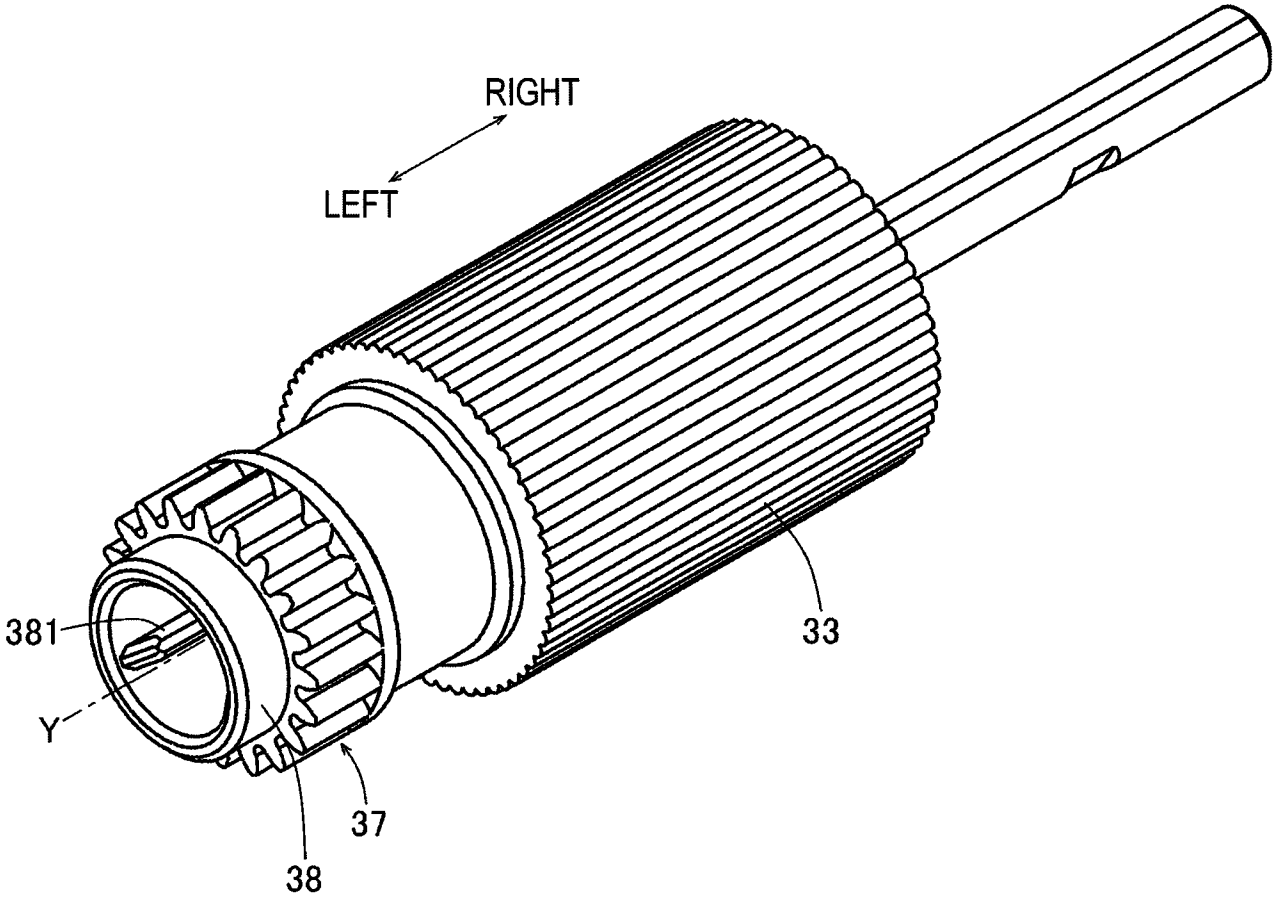
FIG. 5 is a perspective view of a roller gear and a separation roller.
Figure 6:
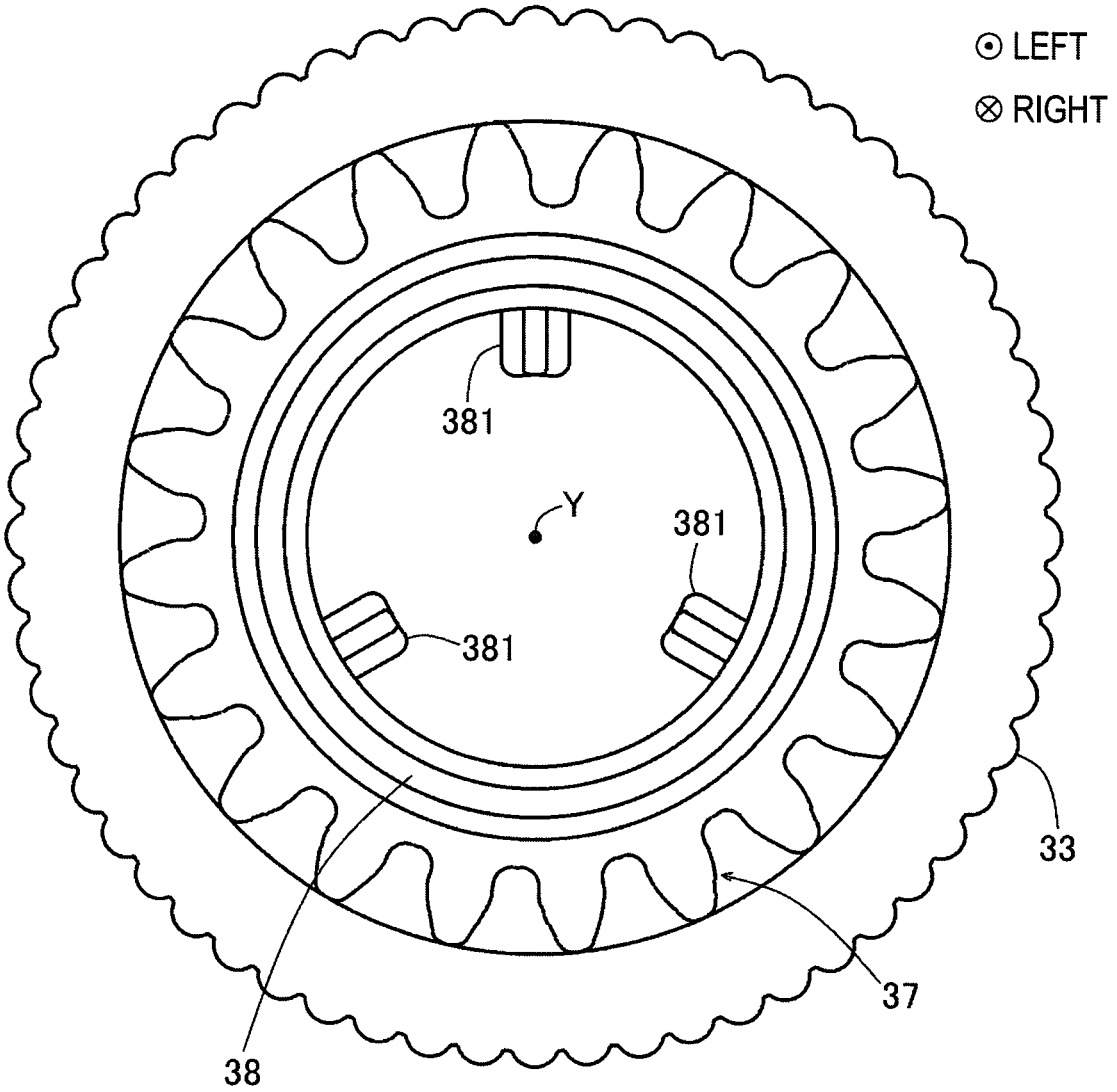
FIG. 6 is an enlarged left side view of a separation roller gear and the separation roller.

As shown in FIGS. 5 and 6, the hollow portion 38 is a cylindrical member of which the center axis is the rotation axis Y located inside the separation roller gear 37. The hollow portion 38 has three protrusions 381 that protrude radially inward from the inner surface (inner circumferential surface) and extend in the rotation axis Y direction. The three protruding portions 381 are arranged at regular intervals along the circumferential direction of the inner surface. The protrusions 381 are members fitted to the right end portion of the separation roller shaft 86, and are formed in a size having strength necessary to receive the driving force from the separation roller shaft 86.

Right End Portion of Separation Roller Shaft

Figure 7:
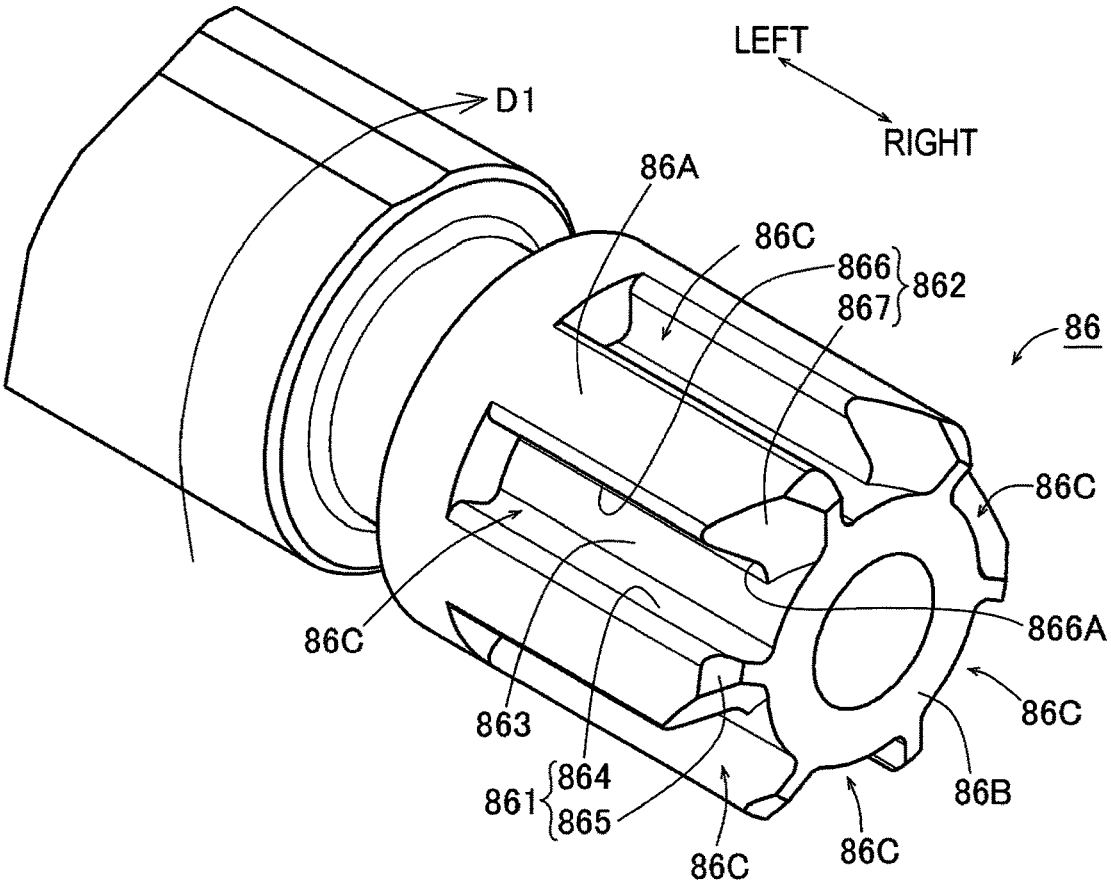
FIG. 7 is a perspective view of a right end portion of a separation roller shaft.
Figure 8:
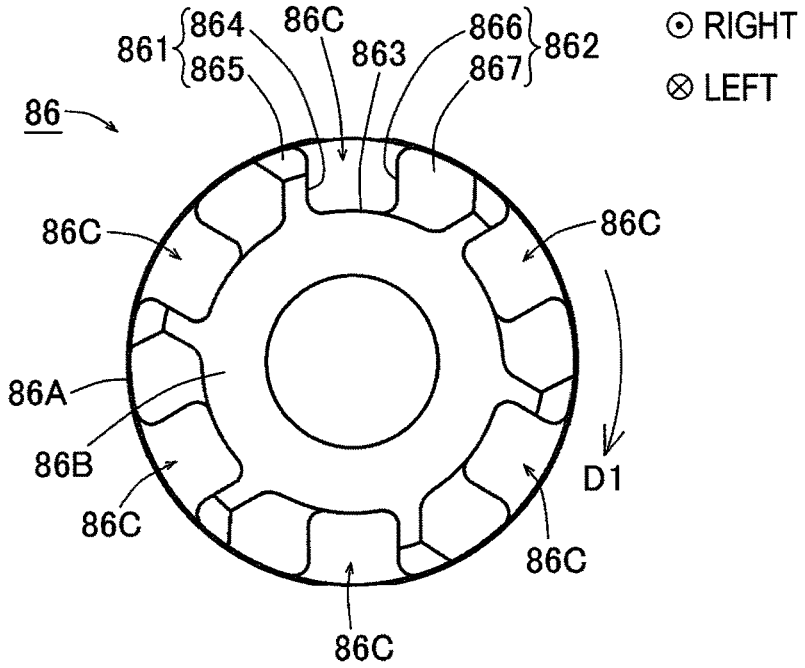
FIG. 8 is a right side view of the right end portion of the separation roller shaft.
Figure 9:
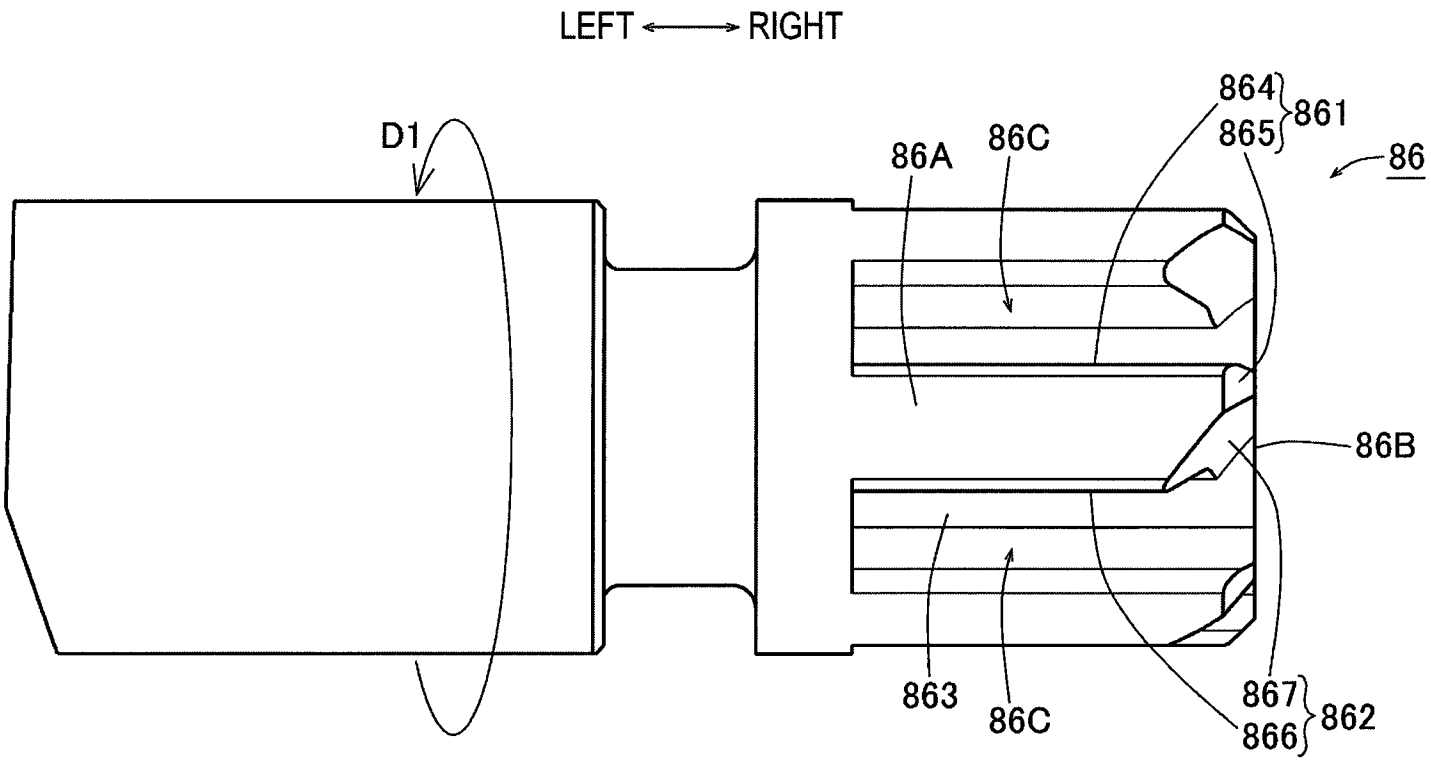
FIG. 9 is a front view of the right end portion of the separation roller shaft.

As shown in FIGS. 7, 8 and 9, the right end portion of the separation roller shaft 86 has an arc-shaped outer circumferential surface 86A, a tip surface (tip end) 86B perpendicular to the left-right direction, and six grooves 86C configured to be fitted with the protrusions 381. The grooves 86C are formed to have a size that allows the separation roller shaft 86 to be inserted into the hollow portion 38. In this example, a plurality of grooves 86C are arranged along the circumferential direction of the separation roller shaft 86 at regular intervals. With this configuration, the protrusion 381 may be inserted into any one of the plurality of grooves 86C, which makes it easy to assemble the separation roller shaft 86 and the hollow portion 38.

The groove 86C has a first side surface 861 located upstream in the first direction D1. The groove 86C has a second side surface 862 facing the first side surface 861 and located downstream in the first direction D1. The groove 86C has a bottom surface 863 that connects the first side surface 861 and the second side surface 862.

The first side surface 861 has a first contact surface 864 that contacts one side surface of the protrusion 381. The first side surface 861 has a first guide surface 865 that is formed by chamfering the connection portion of the tip surface 86B and the outer circumferential surface 86A and that guides the outer circumferential surface 86A of the separation roller shaft 86 to the inner surface of the hollow portion 38. The second side surface 862 has a second contact surface 866 that is smaller than the first contact surface 864 and contacts the other side surface of the protrusion 381. The second side surface 862 has a second guide surface 867 that is inclined away from the first contact surface 864 in a direction from the right end (tip side end 866A) of the second contact surface 866 toward the right end (tip end) of the separation roller shaft 86 (that is, a direction from the left end toward the right end of the separation roller shaft 86). The tip-side end 866A is an end facing toward the right end (tip end) of the separation roller shaft 86. The second guide surface 867 is an example of a guide surface configured to guide the protrusion 381 to the groove 86C.

In this embodiment, the first contact surface 864 adjoins the outer circumferential surface 86A, the bottom surface 863, and the first guide surface 865. The first guide surface 865 adjoins the outer circumferential surface 86A, the tip surface 86B, the first contact surface 864, and the second guide surface 867. The second contact surface 866 adjoins the outer circumferential surface 86A, the bottom surface 863, and the second guide surface 867. The second guide surface 867 adjoins the outer circumferential surface 86A, the tip surface 86B, the first guide surface 865, and the second contact surface 866.

In this embodiment, the second guide surface 867 is larger than the first guide surface 865 and smaller than the second contact surface 866. Alternatively, the second guide surface 867 may be larger than the second contact surface 866. The first guide surface 865 is not an essential component.

Connection Between Separation Roller Shaft and Roller Gear

Figure 10:
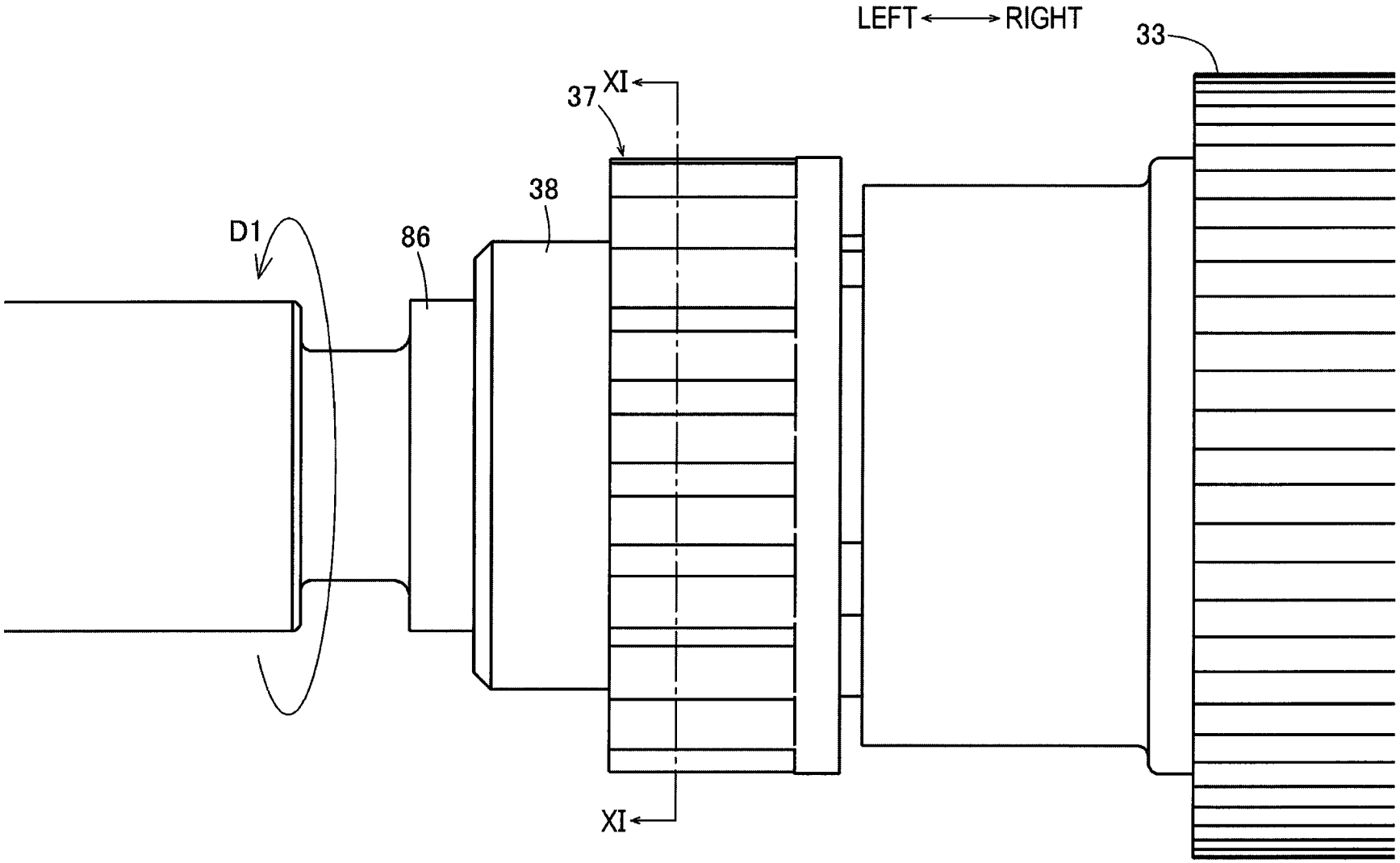
FIG. 10 is a partial front view of a state where the separation roller shaft and the roller gear are connected.

The process of assembling the separation roller shaft 86 and the separation roller gear 37 will be described while referring to FIGS. 10, 11 and 12. First, when the tip surface 86B of the separation roller shaft 86 is inserted into the hollow portion 38, the first guide surface 865 moves along the tip of the hollow portion 38, whereby the outer circumferential surface 86A is guided to the inner surface of the hollow portion 38. Next, when the groove 86C is fitted to the protrusion 381, the tip of the protrusion 381 moves along the second guide surface 867, whereby the protrusion 381 is guided to the groove 86C. This ensures ease of assembly between the separation roller shaft 86 and the hollow portion 38.

Figure 11:
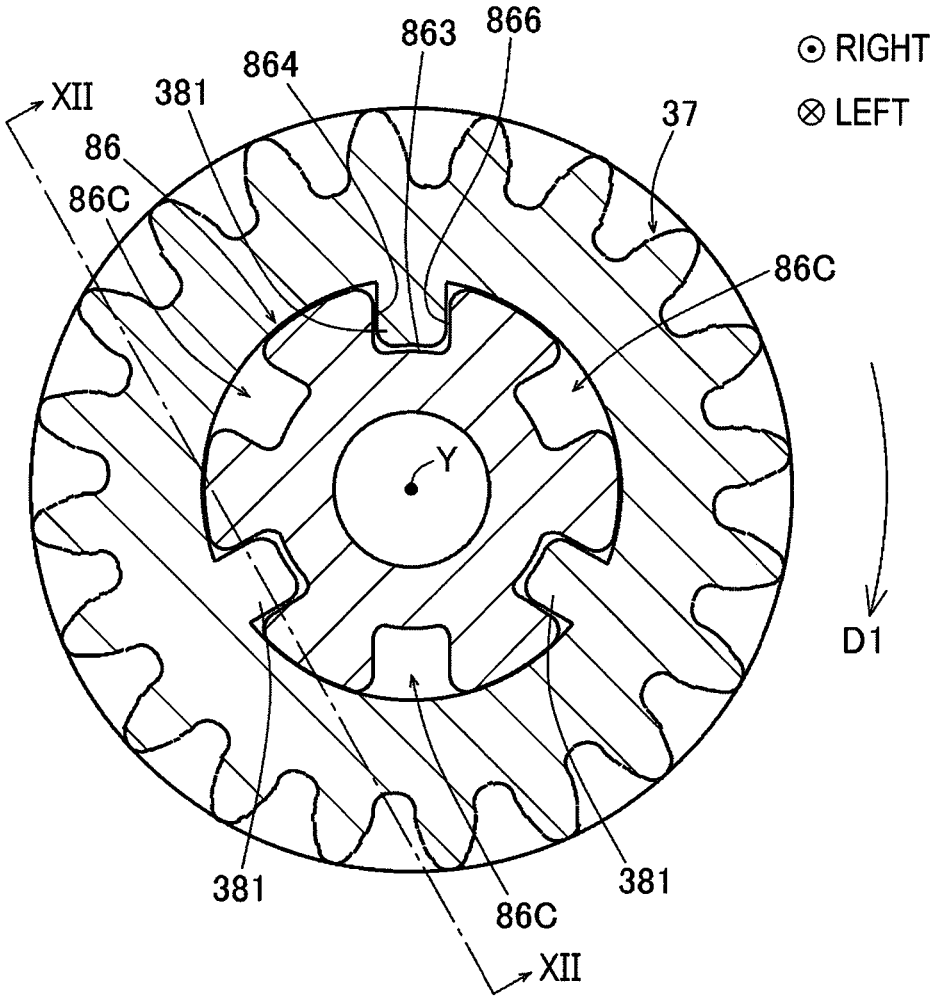
FIG. 11 is a cross-sectional view taken along a line XI-XI in FIG. 10.
Figure 12:
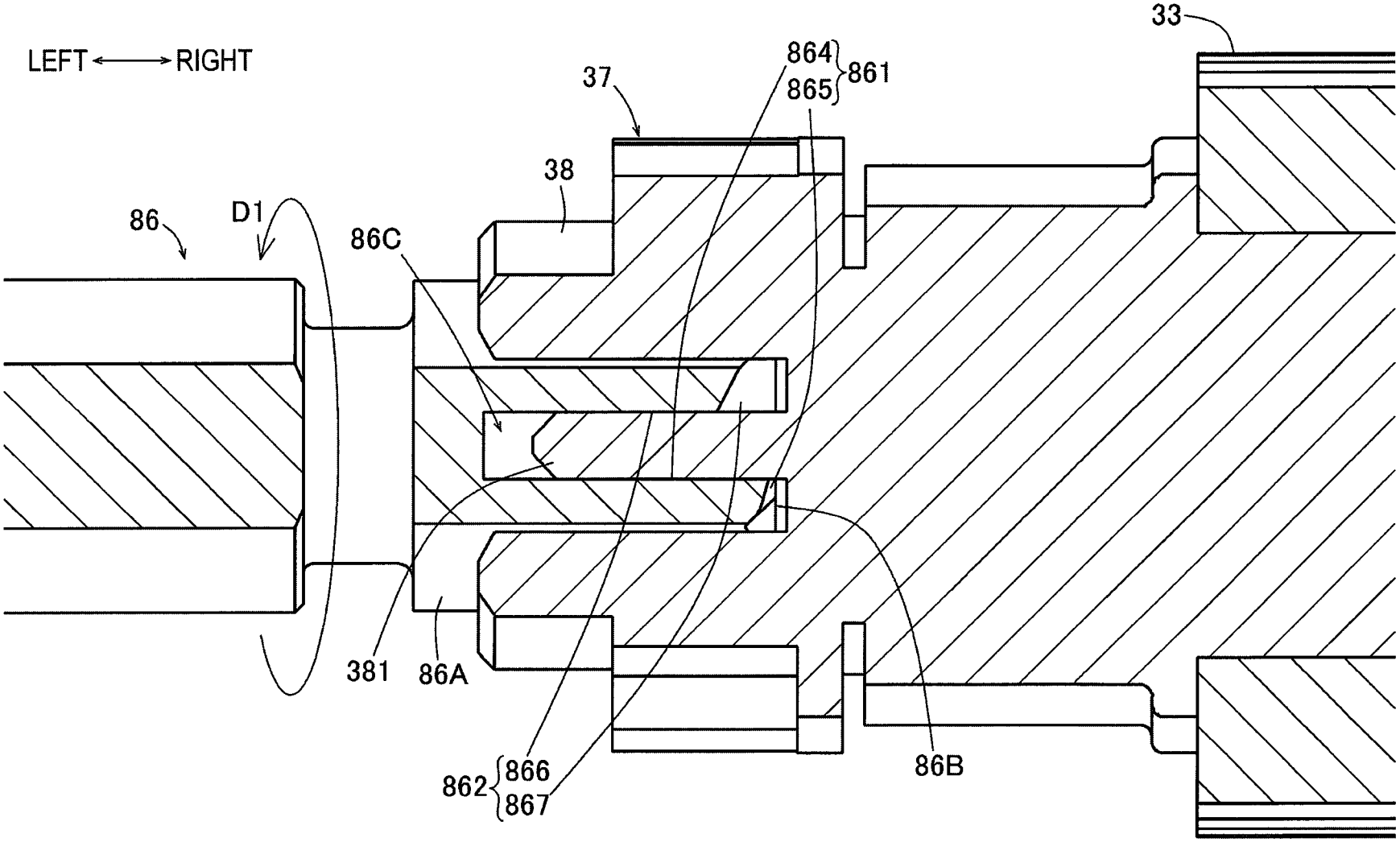
FIG. 12 is a cross-sectional view taken along a line XII-XII in FIG. 11 in a state where the separation roller shaft and the roller gear are connected.

As shown in FIGS. 11 and 12, when the separation roller shaft 86 rotates in the first direction D1 due to the driving force of the forward rotation of the motor 90, the driving force is transmitted from the separation roller shaft 86 to the hollow portion 38 by the first contact surface 864 pressing the protrusion 381. That is, surface pressure is applied to the contact portion between the first contact surface 864 and the protrusion 381, and no surface pressure is applied to the contact portion between the second contact surface 866 and the protrusion 381.

As described above, the first contact surface 864 is larger than the second contact surface 866. Since the first contact surface 864 to which surface pressure is applied when the separation roller shaft 86 rotates in the first direction D1 is larger than the second contact surface 866 to which no surface pressure is applied, the strength needed for transmitting the driving force is secured. Further, since the second guide surface 867 is provided while the second contact surface 866 is made small, the size of the hollow portion 38 is reduced while securing the area of the first contact surface 864.

In the embodiment, the first contact surface 864 and the second contact surface 866 are parallel, but may be tapered to narrow leftward. In this case, the protrusion 381 also has a tapered shape narrowing leftward. This makes it easier to insert the protrusion 381 into the groove 86C, and further facilitates assembly of the separation roller shaft 86 and the hollow portion 38.

In the above-described embodiment, a combination of three protrusions 381 and six grooves 86C is described, but the number of protrusions 381 may be less than or equal to the number of grooves 86C. When there are six grooves 86C as in the above-described embodiment, one to six protrusions 381 may be provided. With this configuration, the protrusion 381 may be inserted into any one of the plurality of grooves 86C, which makes it easy to assemble the separation roller shaft 86 and the hollow portion 38. Further, in a case where the hollow portion 38 has a plurality of protrusions 381, the surface pressure applied to each protrusion 381 is reduced, and thus the size of the hollow portion 38 may be further reduced.

In the above-described embodiment, the separation roller 33 is provided with the separation roller gear 37, and the separation roller shaft 86 is connected. Alternatively, the supply roller 32 may be provided with a roller gear having the same configuration as the separation roller gear 37, and a drive shaft having the same configuration as the separation roller shaft 86 may be connected. In this case, too, effects similar to those of the above-described embodiment are obtained.

In the image forming apparatus 1 described above, the sheet conveyor is composed of the supply section 3, the drive section 7, and so on. Further, the supply mechanism 36 may be driven by a configuration similar to that of the drive section 7. In this case, the sheet conveyor is composed of the MP tray 24, the supply mechanism 36, and so on.

Figure 13:
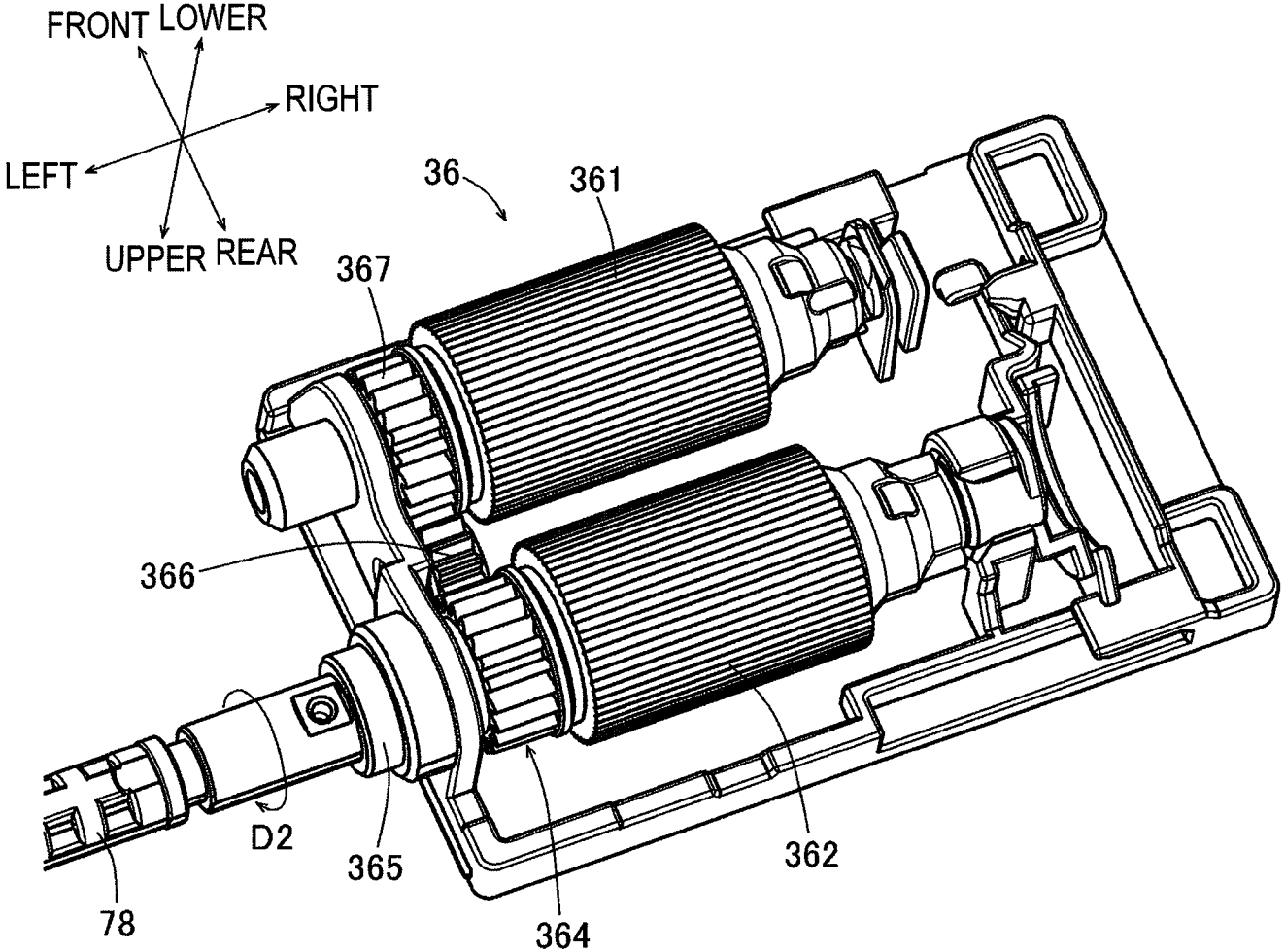
FIG. 13 is a perspective view of a bottom side of a supply mechanism and the separation roller shaft.

A joint mechanism in the supply mechanism 36 as a modification of the above-described joint mechanism will be described while referring to FIG. 13. The driving force transmission train includes a separation roller shaft 78 as a driving force transmission train for transmitting driving force to the supply mechanism 36.

A separation roller gear 364 is provided at the left end of the separation roller 362. The separation roller gear 364 has a hollow portion 365 into which the right end portion of the separation roller shaft 78 is fitted. The hollow portion 365 has the same configuration as the hollow portion 38 described above, and has three protrusions 381. The right end portion of the separation roller shaft 78 and the hollow portion 365 are connected to form a joint mechanism.

According to this configuration, the separation roller shaft 78 is rotated in a first direction D2 (the direction of feeding the sheet S) by the driving force of the forward rotation of the motor 90, whereby the separation roller gear 364 and the separation roller 362 rotate in the first direction D2. Note that the first direction D2 in the supply mechanism 36 is opposite to the first direction D1 in the supply section 3.

The separation roller gear 364 engages with an idle gear 366. The idle gear 366 engages with a supply roller gear 367 provided at the left end of the supply roller 361. Thus, rotation of the separation roller gear 364 causes the idle gear 366, the supply roller gear 367, and the supply roller 361 to rotate.

The separation roller 362 has a one-way clutch (not shown) similar to the one-way clutch 331 described above. Thus, when the separation roller 362 rotates in the first direction D2 by following the sheet S in a state where the separation roller shaft 78 is stopped and the separation roller 362 is not driven, the separation roller 362 rotates idly relative to the separation roller shaft 78. Thus, excessive surface pressure is not applied to the fitting part between the right end portion of the separation roller shaft 78 and the hollow portion 365.

Right End Portion of Separation Roller Shaft

Figure 14:
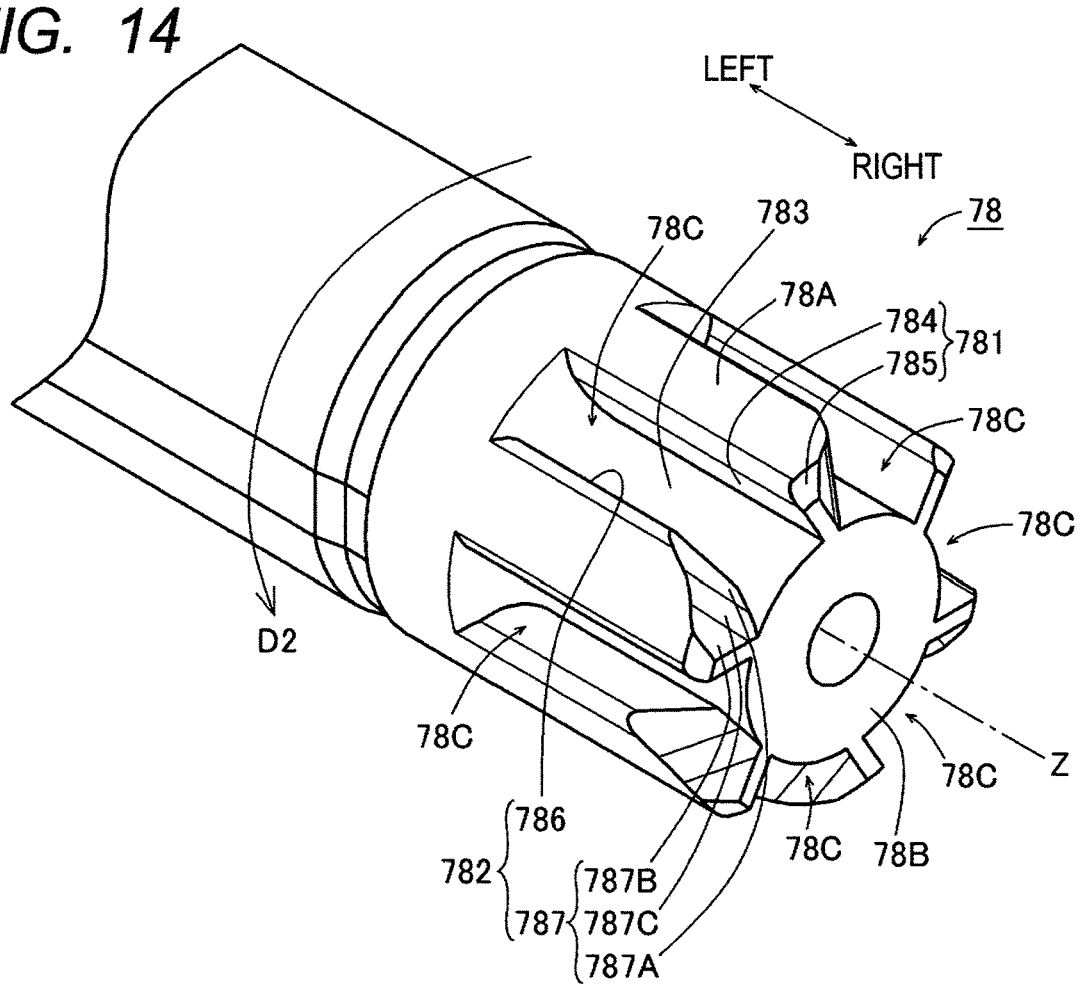
FIG. 14 is a perspective view of the right end portion of the separation roller shaft.
Figure 15:
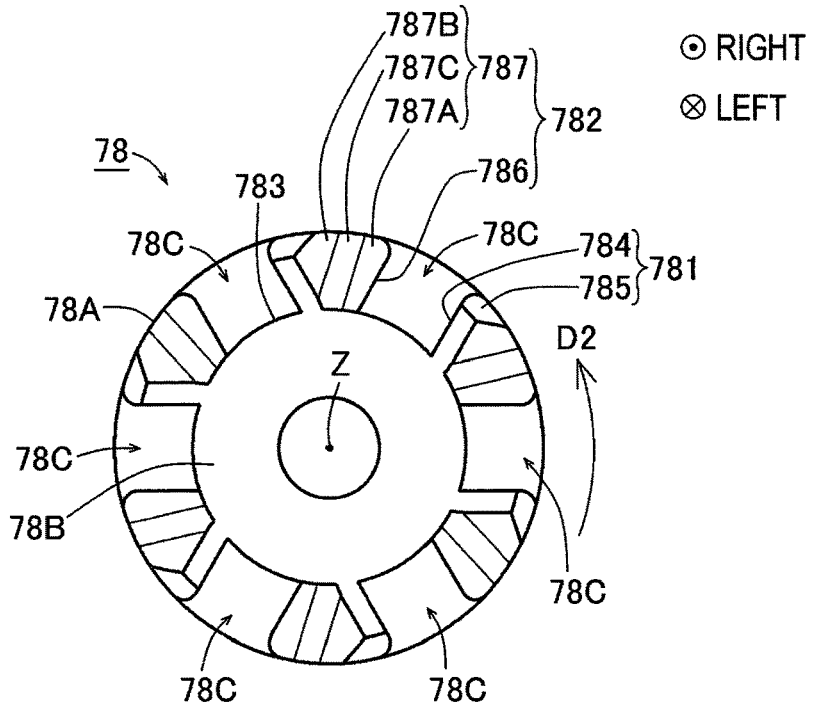
FIG. 15 is a right side view of the right end portion of the separation roller shaft.
Figure 16:
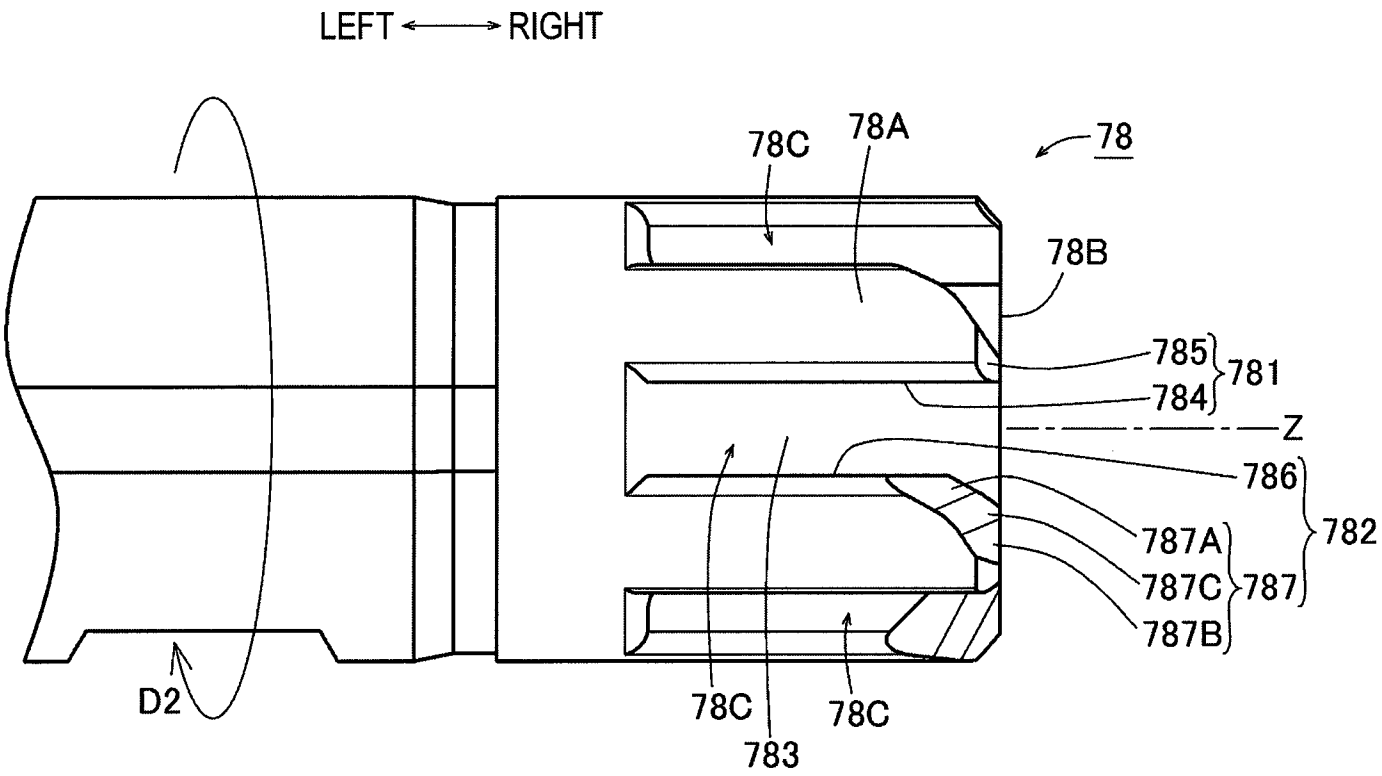
FIG. 16 is a front view of the right end portion of the separation roller shaft.

As shown in FIGS. 14, 15, and 16, the right end portion of the separation roller shaft 78 has an outer circumferential surface 78A, a tip surface (end surface) 78B, and six grooves 78C, like the separation roller shaft 86 of the above-described embodiment. The groove 78C has a first side surface 781, a second side surface 782, and a bottom surface 783. The first side surface 861 has a first contact surface 784 and a first guide surface 785. The second side surface 782 has a second contact surface 786 and a second guide surface 787. Since the rotation direction of the separation roller shaft 78 in this modification is opposite to the rotation direction of the separation roller shaft 86 in the above-described embodiment, the first side surface 781 and the second side surface 782 are arranged oppositely.

The separation roller shaft 78 of this modification differs from the separation roller shaft 86 of the above-described embodiment in the shape of the second guide surface 787. While the second guide surface 867 of the above-described embodiment is a flat surface, the second guide surface 787 of this modification has a first flat surface 787A, a second flat surface 787B, and a curved surface 787C.

The first flat surface 787A is a flat surface extending from the tip of the second contact surface 786 toward the tip of the separation roller shaft 78. The second flat surface 787B is a flat surface extending from the tip of the separation roller shaft 78 toward the tip of the second contact surface 786, and forming a larger angle with the rotation axis Z of the separation roller shaft 78 than the first flat surface 787A is (that is, an angle formed between the second flat surface 787B and the rotation axis Z is larger than an angle formed between the first flat surface 787A and the rotation axis Z). The curved surface 787C is a convex curved surface connecting the first flat surface 787A and the second flat surface 787B. The curved surface 787C may be, for example, an arcuate surface. The first flat surface 787A, the second flat surface 787B, and the curved surface 787C are formed to have approximately the same area.

In this way, because the second guide surface 787 has the first flat surface 787A and the second flat surface 787B, the volume of the right end portion of the separation roller shaft 78 becomes larger than a case where the second guide surface 787 is formed of one flat surface. Thus, the strength is improved and the moldability during injection-molding with resin is improved. In addition, because the second guide surface 787 has the first flat surface 787A and the second flat surface 787B, it is easier to measure finished dimensions than a case where the second guide surface 787 is formed entirely of curved surfaces, and thus it is easy to manage.

Further, since the second guide surface 787 has the curved surface 787C, the curved surface 787C smoothly connects the first flat surface 787A and the second flat surface 787B, and thus the protrusion 381 is smoothly guided along the second guide surface 787. The curved surface 787C is not an essential component. For example, the first flat surface 787A and the second flat surface 787B may be directly connected. Further, a flat surface may be used instead of the curved surface 787C.

In the process of assembling the separation roller shaft 78 and the separation roller gear 364, when the groove 78C is fitted to the protrusion 381, the tip of the protrusion 381 moves along the second flat surface 787B, the curved surface 787C, and the first flat surface 787A in order, whereby the protrusion 381 is guided to the groove 78C. Thus, as in the above-described embodiment, ease of assembly between the separation roller shaft 78 and the hollow portion 365 is ensured.

Note that the configuration of the joint mechanism in the supply mechanism 36 may be used as the joint mechanism in the supply section 3. Conversely, the configuration of the joint mechanism in the supply section 3 may be used as the joint mechanism in the supply mechanism 36.

Arrangement for Positioning Spring for Actuator

As shown in FIGS. 17 to 20, the supply section 3 includes an actuator 91, a spring 92 for the actuator 91, a frame 93 supporting the actuator 91, and an actuator cover 94.

The actuator 91 is arranged downstream of the registration roller 35*a* in the conveyance path P. The actuator 91 is used as a sensor for detecting the sheet S in order to control driving of the registration rollers 35*a*. The actuator is pushed by the sheet S conveyed along the conveyance path P and tilts from an OFF position to an ON position. The actuator 91 includes a tilting portion 911 and a rotation shaft portion 912. The tilting portion 911 extends from below the conveyance path P into the conveyance path P and is tilted by the conveyed sheet S. The rotation shaft portion 912 extends in the left-right direction from the base portion of the tilting portion 911.

Figure 18:
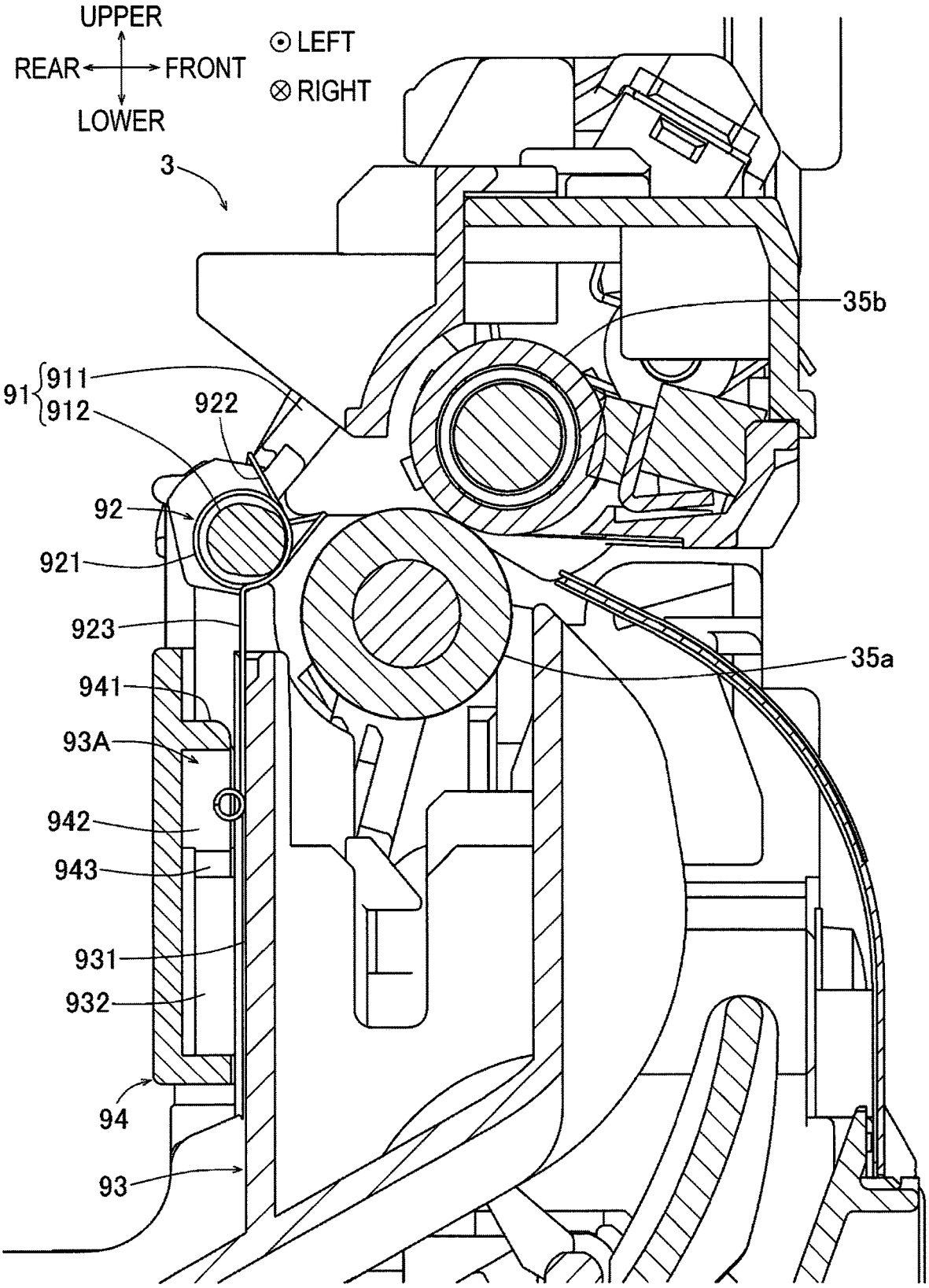
FIG. 18 is an enlarged cross-sectional view taken along a line XVIII-XVIII of FIG. 17.

The spring 92 is a member that urges the actuator 91 in the direction from the ON position to the OFF position. The spring 92 is a torsion coil spring. The spring 92 includes a coil portion 921 that is inserted to and supported by the rotation shaft portion 912 on the left side of the tilting portion 911, a first arm portion 922 that extends from one end of the coil portion 921, and a second arm portion 923 that extends from the other end of the coil portion 921. As shown in FIG. 18, the first arm portion 922 is fixed to the actuator 91, and the second arm portion 923 is sandwiched and supported between the frame 93 and the actuator cover 94.

Figure 19:
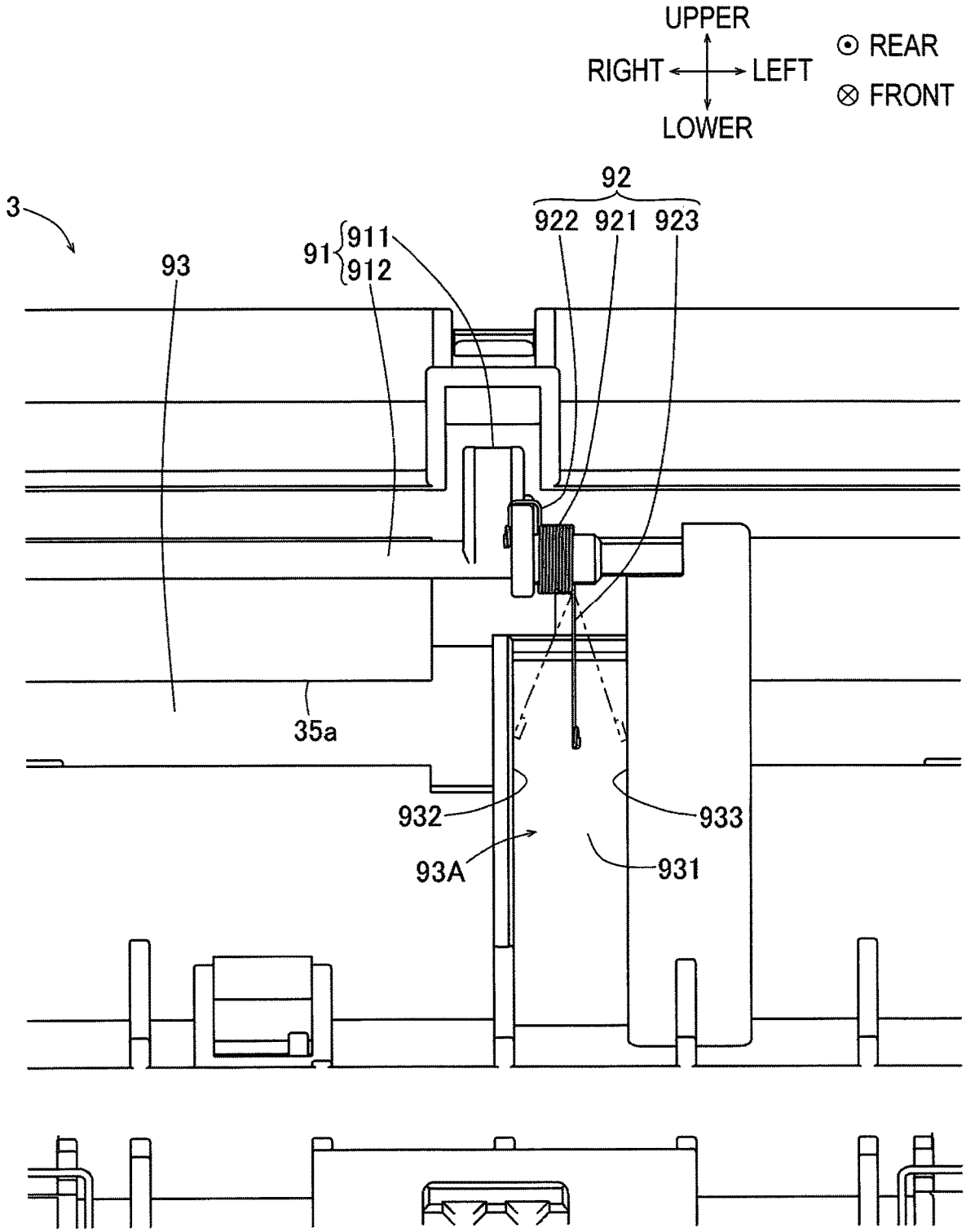
FIG. 19 is a partial enlarged view showing a state before an actuator cover is attached in FIG. 17.

The frame 93 is a member that supports the actuator 91 and the registration roller 35*a*. The frame 93 rotatably supports the right end and left end of the actuator 91. As shown in FIG. 19, the frame 93 has an accommodating portion 93A that accommodates the second arm portion 923 of the spring 92. The accommodating portion 93A has a front surface 931 that contacts the second arm portion 923 from the front to support the second arm portion 923, a right surface 932 that is arranged to the right of the second arm portion 923 with an interval and that extends in the vertical direction, and a left surface 933 that is arranged to the left of the second arm portion 923 with an interval and that extends in the vertical direction.

Figure 17:
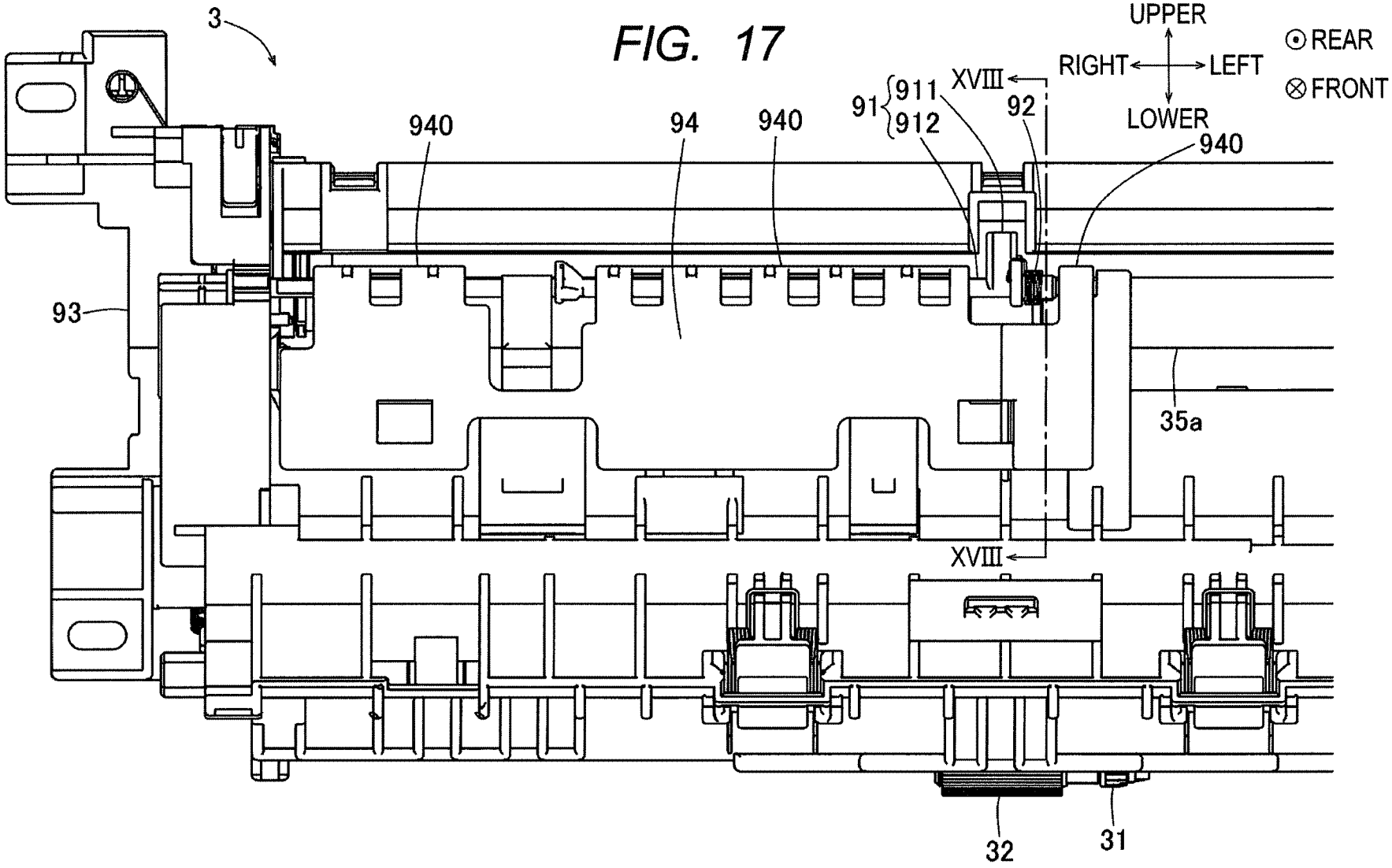
FIG. 17 is a rear view showing a part of a supply section.

The actuator cover 94 is a member that covers the actuator 91 in order to make it difficult for the user to touch the actuator 91 and to reduce foreign matter such as paper dust adhering to the actuator 91. As shown in FIG. 17, the actuator cover 94 has a plurality of curved portions 940 covering the rotation shaft portion 912 of the actuator 91 at its upper portion. The actuator cover 94 has a structure that is fixed to a hook (not shown) and so on of the frame 93 by sliding the actuator cover 94 downward relative to the frame 93.

Figure 20:
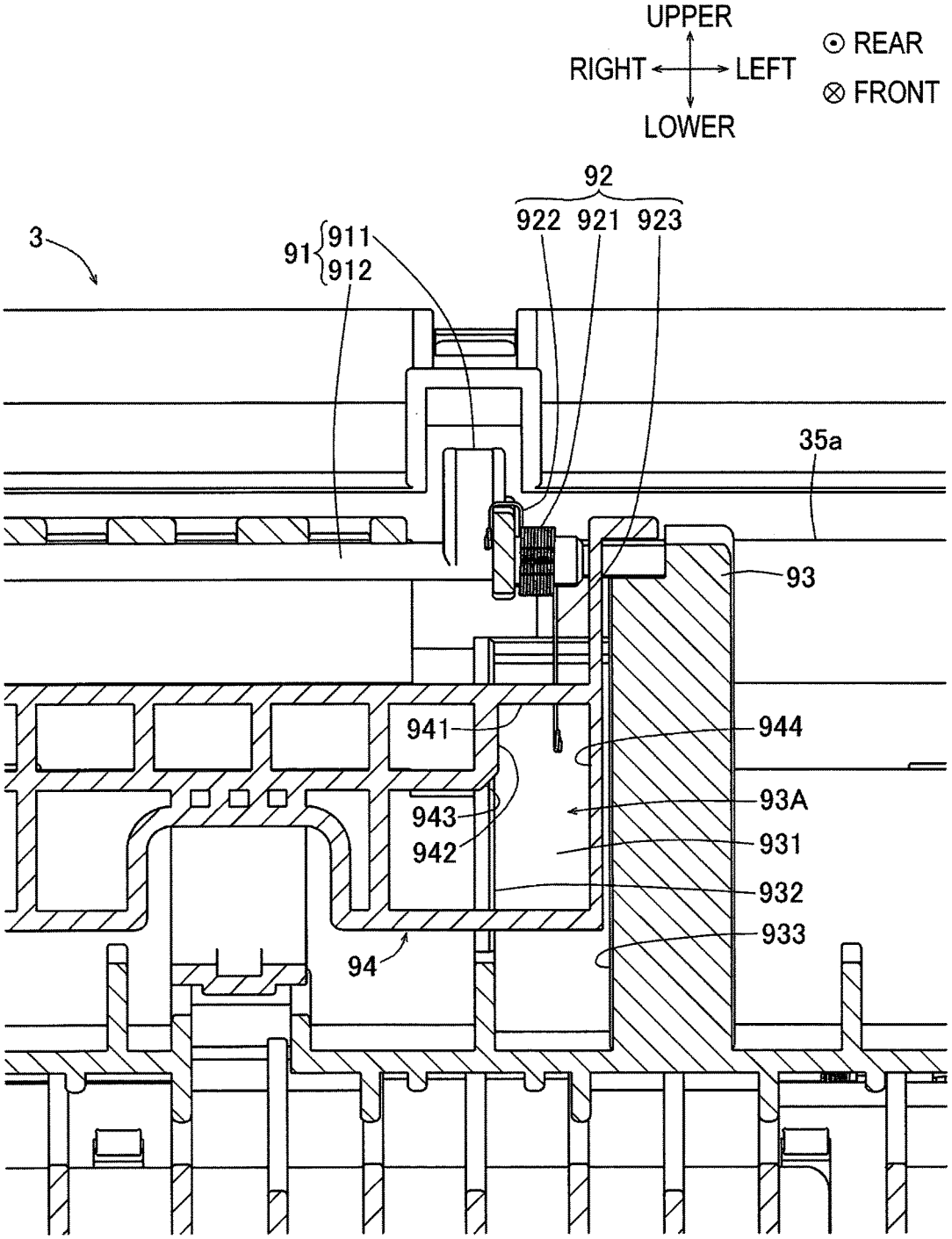
FIG. 20 is a partial cross-sectional enlarged view showing a state where the actuator cover is cut along a plane perpendicular to a front-rear direction in FIG. 17.

The actuator cover 94 has a plurality of ribs at its front side, and these ribs constitute a rear regulating portion 941 (see FIG. 18), a right regulating surface 942 (see FIG. 20), an inclined surface 943, and a left regulating surface 944 (see FIG. 20). The rear regulating portion 941 is a rib that regulates rearward movement of the second arm portion 923.

The right regulating surface 942 is a surface that regulates the rightward displacement of the second arm portion 923. The right regulating surface 942 protrudes forward and extends in the vertical direction. The right regulating surface 942 is located farther leftward than the right surface 932 of the frame 93. The lower end of the right regulating surface 942 is located at a lower position than the lower end of the second arm portion 923. The inclined surface 943 is a surface extending downward and rightward from the lower end of the right regulating surface 942.

The left regulating surface 944 is a surface that regulates the leftward displacement of the second arm portion 923. The left regulating surface 944 protrudes forward and extends in the vertical direction. The left regulating surface 944 is located farther rightward than the left surface 933 of the frame 93. The lower end of the left regulating surface 944 is located at a lower position than the lower end of the second arm portion 923.

Thus, the interval between the right regulating surface 942 and the left regulating surface 944 in the left-right direction is narrower than the interval of the accommodating portion 93A of the frame 93 in the left-right direction. Thus, the position of the second arm portion 923 of the spring 92 in the left-right direction is regulated by the right regulating surface 942 and the left regulating surface 944.

Thus, it is possible to increase the width of the accommodating portion 93A in the left-right direction so that the second arm portion 923 of the spring 92 is easily accommodated in the accommodating portion 93A during assembly. Since the actuator cover 94 has the right regulating surface 942 and the left regulating surface 944, the second arm portion 923 is positioned with respect to the left-right direction.

Next, the assembly procedure will be described. First, as shown in FIG. 19, the coil portion 921 of the spring 92 is inserted into the actuator 91 to attach the first arm portion 922, and then the actuator 91 is attached to the frame 93. In this state, the second arm portion 923 of the spring 92 is located in the accommodating portion 93A of the frame 93. Since the accommodating portion 93A has a large width in the left-right direction, the second arm portion 923 is easily accommodated in the accommodating portion 93A. At this time, the spring 92 is not perfectly positioned in the left-right direction, and the second arm portion 923 may be displaced to a position inclined in the left-right direction within the accommodating portion 93A, as indicated by the two-dot chain line in FIG. 19.

Next, as shown in FIG. 20, the actuator cover 94 is pressed against the frame 93 above a mount position and slides the actuator cover 94 downward to fix the same to the frame 93. Thereby, the second arm portion 923 of the spring 92 is located between the right regulating surface 942 and the left regulating surface 944. That is, when the second arm portion 923 is tilted leftward, the second arm portion 923 is restricted rightward by the left regulating surface 944, and when the second arm portion 923 is tilted rightward, the second arm portion 923 is restricted leftward by the right regulating surface 942, and thus the second arm portion 923 is positioned.

Here, in a state where the actuator cover 94 is pressed against the frame 93 above the mount position, the lower end of the second arm portion 923 is located at a lower position than the inclined surface 943. In this state, when the second arm portion 923 is tilted rightward, by sliding the actuator cover 94 downward, the lower end of the second arm portion 923 is guided along the inclined surface 943 to the right regulating surface 942. Thus, the lower end of the second arm portion 923 is smoothly positioned without being caught by the lower end of the right regulating surface 942.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described invention may be provided as appropriate.

What is claimed is:

1. A sheet conveyor comprising:

a sheet tray configured to support a sheet;

a motor;

a drive shaft extending in an axial direction, the drive shaft having a tip end in the axial direction, the drive shaft having an end portion including the tip end, the drive shaft being rotatable in a first direction by receiving driving force of a forward rotation of the motor;

a roller rotatable to feed the sheet supported by the sheet tray; and a hollow portion provided at the roller coaxially with the roller, the end portion of the drive shaft being inserted in the hollow portion, the hollow portion having an inner surface and a protrusion, the protrusion protruding radially inward from the inner surface and extending in the axial direction, the end portion of the drive shaft having a groove configured to fit to the protrusion, the groove having a first side surface and a second side surface, the second side surface facing the first side surface and located downstream of the first side surface in the first direction, the first side surface having a first contact surface configured to contact one side surface of the protrusion, the second side surface having a second contact surface and a guide surface, the second contact surface being smaller than the first contact surface, the second contact surface being configured to contact an other side surface of the protrusion, the guide surface being inclined away from the first contact surface in a direction from a tip-side end of the second contact surface toward the tip end of the drive shaft, the tip-side end of the second contact surface being an end facing toward the tip end of the drive shaft, the guide surface being configured to guide the protrusion to the groove.

2. The sheet conveyor according to claim 1, wherein the guide surface includes:

a first flat surface extending from the tip-side end of the second contact surface toward the tip end of the drive shaft; and a second flat surface extending from the tip end of the drive shaft toward the tip-side end of the second contact surface, an angle formed between the second flat surface and the axial direction being greater than an angle formed between the first flat surface and the axial direction.

3. The sheet conveyor according to claim 2, wherein the guide surface includes a curved surface connecting the first flat surface and the second flat surface, the curved surface being curved in a convex shape.

4. The sheet conveyor according to claim 1, wherein the end portion has a plurality of grooves arranged at regular intervals in a circumferential direction.

5. The sheet conveyor according to claim 4, wherein the hollow portion includes a particular number of protrusions in the circumferential direction, the particular number being a same as or less than a number of the plurality of grooves.

6. The sheet conveyor according to claim 1, further comprising:

a supply roller configured to supply sheets supported by the sheet tray, wherein the roller is a separation roller configured to separate the sheets supplied from the supply roller into one sheet at a time and to convey the one sheet; and wherein the roller includes a one-way clutch configured to:

connect to the drive shaft when the drive shaft rotates in the first direction; and allow the roller to rotate in the first direction when the drive shaft is stopped.

7. The sheet conveyor according to claim 1, further comprising:

an electromagnetic clutch arranged between the motor and the drive shaft, the electromagnetic clutch being configured to switch between:

a connection state where driving force from the motor is transmitted to the drive shaft; and a cut-off state where the driving force from the motor is not transmitted to the drive shaft.

8. The sheet conveyor according to claim 1, wherein the end portion has a tip surface and an outer circumferential surface;

wherein the first side surface has an other guide surface that is formed by chamfering a connection portion of the tip surface and the outer circumferential surface; and wherein the guide surface is larger than the other guide surface.

9. An image forming apparatus comprising:

a sheet conveyor; and a print engine configured to form an image on a sheet fed from the sheet conveyor, the sheet conveyor comprising:

a sheet tray configured to support the sheet;

a motor;

a drive shaft extending in an axial direction, the drive shaft having a tip end in the axial direction, the drive shaft having an end portion including the tip end, the drive shaft being rotatable in a first direction by receiving driving force of a forward rotation of the motor;

a roller rotatable to feed the sheet supported by the sheet tray; and a hollow portion provided at the roller coaxially with the roller, the end portion of the drive shaft being inserted in the hollow portion, the hollow portion having an inner surface and a protrusion, the protrusion protruding radially inward from the inner surface and extending in the axial direction, the end portion of the drive shaft having a groove configured to fit to the protrusion, the groove having a first side surface and a second side surface, the second side surface facing the first side surface and located downstream of the first side surface in the first direction, the first side surface having a first contact surface configured to contact one side surface of the protrusion, the second side surface having a second contact surface and a guide surface, the second contact surface being smaller than the first contact surface, the second contact surface being configured to contact an other side surface of the protrusion, the guide surface being inclined away from the first contact surface in a direction from a tip-side end of the second contact surface toward the tip end of the drive shaft, the tip-side end of the second contact surface being an end facing toward the tip end of the drive shaft, the guide surface being configured to guide the protrusion to the groove.

10. The image forming apparatus according to claim 9, wherein the guide surface includes:

a first flat surface extending from the tip-side end of the second contact surface toward the tip end of the drive shaft; and a second flat surface extending from the tip end of the drive shaft toward the tip-side end of the second contact surface, an angle formed between the second flat surface and the axial direction being greater than an angle formed between the first flat surface and the axial direction.

11. The image forming apparatus according to claim 10, wherein the guide surface includes a curved surface connecting the first flat surface and the second flat surface, the curved surface being curved in a convex shape.

12. The image forming apparatus according to claim 9, wherein the end portion has a plurality of grooves arranged at regular intervals in a circumferential direction.

13. The image forming apparatus according to claim 12, wherein the hollow portion includes a particular number of protrusions in the circumferential direction, the particular number being a same as or less than a number of the plurality of grooves.

14. The image forming apparatus according to claim 9, further comprising:

a supply roller configured to supply sheets supported by the sheet tray, wherein the roller is a separation roller configured to separate the sheets supplied from the supply roller into one sheet at a time and to convey the one sheet; and wherein the roller includes a one-way clutch configured to:

connect to the drive shaft when the drive shaft rotates in the first direction; and allow the roller to rotate in the first direction when the drive shaft is stopped.

15. The image forming apparatus according to claim 9, further comprising:

an electromagnetic clutch arranged between the motor and the drive shaft, the electromagnetic clutch being configured to switch between:

a connection state where driving force from the motor is transmitted to the drive shaft; and a cut-off state where the driving force from the motor is not transmitted to the drive shaft.

16. The image forming apparatus according to claim 9, wherein the end portion has a tip surface and an outer circumferential surface;

wherein the first side surface has an other guide surface that is formed by chamfering a connection portion of the tip surface and the outer circumferential surface; and wherein the guide surface is larger than the other guide surface.

17. A sheet conveyor comprising:

a motor;

a sheet tray configured to support sheets;

a supply roller configured to supply the sheets supported by the sheet tray, a separation roller configured to separate the sheets supplied from the supply roller into one sheet at a time and to convey the one sheet, and a drive shaft extending in an axial direction, the drive shaft having a tip end in the axial direction, the drive shaft having an end portion including the tip end, the drive shaft being rotatable in a first direction by receiving driving force of a forward rotation of the motor, the drive shaft configured to transmit the driving force to the separation roller;

the end portion of the drive shaft having a groove, the groove having a first side surface and a second side surface, the second side surface facing the first side surface and located downstream of the first side surface in the first direction, the first side surface having a first contact surface, the second side surface having a second contact surface and a guide surface, the second contact surface being smaller than the first contact surface, the guide surface being inclined away from the first contact surface in a direction from a tip-side end of the second contact surface toward the tip end of the drive shaft, the tip-side end of the second contact surface being an end facing toward the tip end of the drive shaft, the separation roller including a one-way clutch configured to:

connect to the drive shaft when the drive shaft rotates in the first direction, and allow the roller to rotate in the first direction when the drive shaft is stopped.

18. The sheet conveyor according to claim 17, wherein the guide surface includes:

a first flat surface extending from the tip-side end of the second contact surface toward the tip end of the drive shaft; and a second flat surface extending from the tip end of the drive shaft toward the tip-side end of the second contact surface, an angle formed between the second flat surface and the axial direction being greater than an angle formed between the first flat surface and the axial direction.

19. The sheet conveyor according to claim 18, wherein the guide surface includes a curved surface connecting the first flat surface and the second flat surface, the curved surface being curved in a convex shape.

20. The sheet conveyor according to claim 17, wherein the end portion has a plurality of grooves arranged at regular intervals in a circumferential direction.

21. The sheet conveyor according to claim 17, further comprising:

an electromagnetic clutch arranged between the motor and the drive shaft, the electromagnetic clutch being configured to switch between:

a connection state where driving force from the motor is transmitted to the drive shaft; and a cut-off state where the driving force from the motor is not transmitted to the drive shaft.

22. The sheet conveyor according to claim 17, wherein the end portion has a tip surface and an outer circumferential surface;

wherein the first side surface has an other guide surface that is formed by chamfering a connection portion of the tip surface and the outer circumferential surface; and wherein the guide surface is larger than the other guide surface.

* * * * *